US006503060B1

(12) United States Patent
Kamada et al.

(10) Patent No.: US 6,503,060 B1
(45) Date of Patent: Jan. 7, 2003

(54) FAN GUARD OF BLOWER UNIT AND AIR CONDITIONER

(75) Inventors: Masashi Kamada, Osaka (JP); Tadashi Ohnishi, Osaka (JP); Manabu Kato, Osaka (JP); Hiroki Ishihara, Osaka (JP); Tatsuo Fujiwara, Osaka (JP); Masaki Yamamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/806,777

(22) PCT Filed: Aug. 8, 2000

(86) PCT No.: PCT/JP00/05293

§ 371 (c)(1),
(2), (4) Date: Apr. 4, 2001

(87) PCT Pub. No.: WO01/11241

PCT Pub. Date: Feb. 15, 2001

(30) Foreign Application Priority Data

Aug. 9, 1999 (JP) ..... 11-225037

(51) Int. Cl.[7] ..... F04D 29/70

(52) U.S. Cl. ..... 416/247 R; 415/121.2; 415/211.2

(58) Field of Search ..... 415/121.2, 191, 415/208.2, 211.2; 416/247 R

(56) References Cited

U.S. PATENT DOCUMENTS

| | | | | | |
|---|---|---|---|---|---|
| 2,100,994 | A | * | 11/1937 | Cohen | 415/121.2 |
| 5,118,252 | A | * | 6/1992 | Chaney | 415/119 |
| 5,391,056 | A | * | 2/1995 | Wang | 416/247 R |
| 5,609,473 | A | * | 3/1997 | Litvin | 416/246 |
| 6,015,265 | A | * | 1/2000 | Lasko et al. | 416/247 R |
| 6,017,191 | A | | 1/2000 | Harmsen | |

FOREIGN PATENT DOCUMENTS

| | | |
|---|---|---|
| DE | 197 53 373 | 6/1998 |
| EP | 0 387 987 | 9/1990 |
| JP | 60-62567 | 4/1985 |
| JP | 99536/1984 | 1/1986 |
| JP | 62-145036 | 9/1987 |
| JP | 34202/1986 | 9/1987 |
| JP | 6-280799 | 10/1994 |
| JP | 962468 | 9/1996 |
| JP | 8-247097 | 9/1996 |

OTHER PUBLICATIONS

Austrian Search Report issued in corresponding Singapore patent application, Date of Mailing: May 15, 2002.

Office Action from the Chinese Patent Office for corresponding Chinese patent application Serial No. 00801618.6, Date of Mailing: Jun. 14, 2002.

* cited by examiner

*Primary Examiner*—Edward K. Look
*Assistant Examiner*—Ninh Nguyen
(74) *Attorney, Agent, or Firm*—Nixon Peabody LLP; Donald R. Studebaker

(57) ABSTRACT

A frame (4*a*) is provided around the perimeter of the air outlet (2*a*) of the fan (6). The frame (4*a*) includes a plurality of board-shaped ribs (41, 41 . . . ) extending radially outward from the vicinity of the center of the frame (4*a*) in the direction of the radius of the fan (6). The frame (4*a*) also includes a plurality of cylindrical ribs (42, 42 . . . ) integrated with the plurality of board-shaped ribs (41, 41 . . . ), and arranged concentrically around the rotation axis (O–O') of the fan (6) at predetermined intervals in the direction of the radius of the fan (6). The board-shaped ribs (41) are curved outward in the direction of rotation of the fan (6) and inclined in the direction of air flowing from the fan (6).

17 Claims, 18 Drawing Sheets

PRIOR ART

PRIOR ART

FAN GUARD OF BLOWER UNIT AND AIR CONDITIONER

TECHNICAL FIELD

The present invention relates to a fan guard for an air blowing unit which does not make noise or a short-circuit while the fan is in operation (blowing air), and to an air-conditioning device provided with the fan guard.

BACKGROUND ART

One example of the air blowing unit is the outdoor unit of an air-conditioning system. As shown in FIGS. 20 and 21, an outdoor unit (20) of an air-conditioning system is composed of a heat exchanger (21) and a propeller fan (22) which are stored in a box-shaped casing. On the front side of the casing, an air outlet (20*a*) is formed by a bell mouth (23), which is a fan guide. A grille-structured fan guard (24) for protecting the fan is arranged to cover the air outlet (20*a*) of the casing.

Rotating the propeller fan (22) causes air to be taken into the casing through the opening for air intake (20*b*) on the rear side. The air passes through the heat exchanger (21), the propeller fan (22), the bell mouth (23), the air outlet (20*a*), and the fan guard (24) in this order so as to be blown toward the front of the outdoor unit (20) as indicated with the arrows.

The fan guard (24) has a grille structure where a plurality of protecting ribs (25, 25 . . . ) and a plurality of supporting ribs (26, 26 . . . ) form a fan-shaped lattice. The protecting ribs (25) are extended in the form of rings around the rotation axis of the propeller fan (22) and are made from a steel wire which is circular in cross section in consideration of the outward appearance. On the other hand, the supporting ribs (26) are extended in the radial direction at predetermined intervals orthogonal to the rotation axis (O–O') of the propeller fan (22), and are made from a steel wire which is circular in cross section. The supporting ribs (26) are welded to the protecting ribs (25) so as to support them.

This structure of the outdoor unit (20) can protect the propeller fan (22) inside the outdoor unit (20), and also makes the fan (22) harder to be seen from outside, thereby enhancing the exterior of the entire casing and also offering a well-balanced structure in terms of design.

PROBLEM SOLUTIONS

However, the above-described prior art fan guard (24) made from a steel wire requires the welding of the supporting ribs (26) to the protecting ribs (25), which increases the cost.

In addition, when a current caused by the propeller fan (22) passes into the fan guard (24), it cannot smoothly follow the surfaces of the ribs (25, 26) because the surfaces are circular in cross section. As a result, the current is split by the surfaces so as to develop vortexes, which leads to a pressure loss and makes noise.

It would be possible to reduce the pressure loss by forming the ribs (25, 26) flat with respective predetermined widths. At the same time, it would be possible to lower the cost by integrally making the ribs (25, 26) from a synthetic resin.

However, in that case, the current from the propeller fan (22) flowing into the fan guard (24) includes a speed component having a predetermined magnitude in the direction of rotation of the propeller fan (22). This makes the direction of the air flowing from the propeller fan (22) disagree with the angle at which the flat surfaces of the ribs (25, 26) are set so that the current comes into collision with the flat surfaces, thereby developing vortexes. This leads to a pressure loss and makes noise.

The velocity of flow of air generated by the propeller fan (22) differs among different positions in the direction of the radius of the fan (22). As known from the measured data shown in FIG. 13, the current from the outer portions of the blades (22*a*) of the propeller fan (22) a little closer to the hub (22*b*) than the tips (27) of the blades (22*a*) has a higher velocity than the current from the tips (27). The velocity distribution in the direction of the radius of the fan (22) indicates that the velocity of the current decreases from the outer portions of the blades (22*a*) both towards the hub (22*b*) side and towards the tips (27) side.

Inside the outer diameter of the hub (22*b*), a difference in pressure causes a reverse current which goes from the downstream side of the propeller fan (22) to the hub (22*b*) side. The reverse current interferes with the current flowing in the intended direction, thereby causing an issue of noise.

When the air blowing unit is applied to the outdoor unit of an air-conditioning system as described above, a short-circuit phenomenon occurs. That is, the air blown by the propeller fan (22) after passing through the heat exchanger (21) spreads outward in the direction of the radius of the fan (22) to be drawn towards the rear side, and again goes into the heat exchanger (21). This short-circuit phenomenon, which deteriorates the air conditioning performance, must be avoided as effectively as possible.

However, the current from the propeller fan (22) generally has a speed component in the centrifugal direction, and tends to spread outward in the direction of the radius of the fan (22). As a result, the air flown out through the fan guard (24) adheres to the front-side wall of the casing due to Coanda effect, and travels towards the heat exchanger (21), which may cause a short-circuit. This tendency is more conspicuous in a case where an oblique fan is used instead of the propeller fan.

DISCLOSURE OF THE INVENTION

Each invention of the present application has been contrived with the aim of solving the above-mentioned problems. In order to achieve the object, the inventions are provided with the following effective problem-solving means.

(1) First Invention

The first invention is provided with a frame (4*a*) arranged around the perimeter of an air outlet (2*a*) of a fan (6), and with a plurality of board-shaped ribs (41, 41 . . . ) extending radially from the vicinity of the center of the frame (4*a*) outward in the direction of the radius of the fan (6).

The board-shaped ribs (41) are outward curved in the direction of rotation of the fan (6), and also inclined in the direction of air flowing from the fan (6).

In other words, the first invention comprises a frame (4*a*) arranged around the perimeter of the air outlet (2*a*) of the fan (6), and a plurality of board-shaped ribs (41, 41 . . . ) extending radially from the vicinity of the center of the frame (4*a*) corresponding to the rotation axis (O–O') of the fan (6) outward in the direction of the radius of the fan (6). The plurality of board-shaped ribs (41, 41 . . . ) are extended in the direction of rotation of the fan (6) and also inclined in the direction of air blowing from the fan (6).

As stated before, there is a case where the air blowing unit is applied to the outer unit of an air-conditioning system. In this case, the occurrence of a short-circuit must be prevented as much as possible because it decreases the air-conditioning performance. The air taken in through the opening for air intake on the back side of the casing passes through a heat exchanger and then is blown off through the air outlet (2*a*) on the front side of the fan (6). It is necessary to avoid a phenomenon in which the blown air is again taken in through the opening for air intake and supplied to the heat exchanger. However, the current generated by the fan (6) arranged upstream of the fan guard (4) tends to flow outward in the direction of the radius of the fan (6). Consequently, if nothing is done, it is likely that the current from the fan guard (4) adheres to the surface of the front wall of the casing due to Coanda effect and travels towards the heat exchanger on the rear side, thereby causing a short circuit.

Therefore, in the first invention, the plurality of board-shaped ribs (41) are curved in the direction of rotation of the fan (6). As a result, the board-shaped ribs (41) makes a force (Fr) inward in the direction of the radius of the fan (6) apply on the current outward in the direction of the radius of the fan (6). Consequently, the current from the fan guard (4) is prevented from flowing outward in the direction of the radius of the fan (6), which reduces the occurrence of a short circuit as much as possible.

As stated above, the current generated by the fan (6) and flowing into the fan guard (4) becomes spinning currents having a speed component in the direction of rotation of the fan (6). As a result, if the direction of the current generated by the fan (6) does not agree with the angle at which the board-shaped ribs (41) are installed, the current is split and noise occurs.

Therefore, in the first invention, the board-shaped ribs (41) are inclined in the direction of air flowing from the fan (6). As a result, the direction of the current from the fan (6) agrees with the angle at which the board-shaped ribs (41) are installed, which can reduce the splitting of the current as much as possible, thereby further lowering the noise.

Since the ribs (41) of the first invention are shaped like boards, the current generated by the fan (6) smoothly follows the surfaces of the board-shaped ribs (41). As a result, splitting of current occurs less, which eliminates the pressure loss and lowers the noise.

(2) Second Invention

The second invention is provided with a frame (4*a*) arranged around the perimeter of an air outlet (2*a*) of a fan (6), and further with a plurality of board-shaped ribs (41, 41 . . . ) extending radially from the vicinity of the center of the frame (4*a*) outward in the direction of the radius of the fan (6). The second invention is further provided with a plurality of nearly cylindrical ribs (42, 42 . . . ) which are integrated with the plurality of board-shaped ribs (41, 41 . . . ) and arranged concentrically around the rotation axis (O–O') of the fan (6) at predetermined intervals in the direction of the radius of the fan (6).

The board-shaped ribs (41) are curved outward in the direction of rotation of the fan (6), and also inclined in the direction of air flowing from the fan (6).

In other words, the second invention comprises a frame (4*a*) arranged around the perimeter of the air outlet (2*a*) of the fan (6), a plurality of board-shaped ribs (41, 41 . . . ) extending radially from the vicinity of the center of the frame (4*a*) corresponding to the rotation axis (O–O') of the fan (6) outward in the direction of the radius of the fan (6), and a plurality of nearly cylindrical ribs (42, 42 . . . ) which are integrated with the plurality of board-shaped ribs (41, 41 . . . ) and arranged concentrically around the rotation axis (O–O') of the fan (6) at predetermined intervals in the direction of the radius of the fan (6). The plurality of board-shaped ribs (41, 41 . . . ) are extended in the direction of rotation of the fan (6) and also inclined in the direction of air flowing from the fan (6).

As stated before, there is a case where the air blowing unit is applied to the outer unit of an air-conditioning system. In this case, the occurrence of a short-circuit must be prevented as much as possible because it decreases the air-conditioning performance. The air taken in through the opening for air intake on the back side of the casing passes through a heat exchanger and then is blown off through the air outlet (2*a*) on the front side of the fan (6). It is necessary to avoid a phenomenon in which the blown air is again taken in through the opening for air intake and supplied to the heat exchanger. However, the current from the fan (6) arranged upstream of the fan guard (4) tends to flow outward in the direction of the radius of the fan (6). Consequently, if nothing is done, it is likely that the current from the fan guard (4) adheres to the surface of the front wall of the casing due to Coanda effect and travels towards the heat exchanger on the rear side, thereby causing a short circuit.

Therefore, in the second invention, the plurality of board-shaped ribs (41) are extended in the direction of rotation of the fan (6). As a result, the board-shaped ribs (41) make a force (Fr) inward in the direction of the radius of the fan (6) act on the current outward in the direction of the radius of the fan (6). Consequently, the current from the fan guard (4) is prevented from flowing outward in the direction of the radius of the fan (6), which reduces the occurrence of a short circuit as much as possible.

The second invention further comprises a plurality of nearly cylindrical ribs (42) which are integrated with the board-shaped ribs (41) and arranged concentrically. This structure makes the whole current in the direction of the radius of the fan (6) be converged forward due to the effect of the nearly cylindrical ribs (42) controlling the direction of the current. This prevents the occurrence of a short circuit further effectively.

As stated above, the current generated by the fan (6) and flowing into the fan guard (4) becomes spinning currents having a speed component in the direction of rotation of the fan (6). As a result, if the direction of the current generated by the fan (6) does not agree with the angle at which the board-shaped ribs (41) are installed, the current is split and noise occurs.

Therefore, in the second invention, the board-shaped ribs (41) are inclined in the direction of air flowing from the fan (6). As a result, the direction of the current from the fan (6) agrees with the angle at which the board-shaped ribs (41) are installed, which can reduce the splitting of the current as much as possible, thereby further lowering the noise.

Since the ribs (41) of the second invention are shaped like boards, the current generated by the fan (6) smoothly follows the surfaces of the board-shaped ribs (41). As a result, splitting of current occurs less, which eliminates the pressure loss and lowers the noise.

(3) Third Invention

The third invention is provided with a frame (4*a*) arranged around the perimeter of an air outlet (2*a*) of a fan (6), and further with a plurality of board-shaped ribs (41, 41 . . . ) extending radially from the vicinity of the center of the frame (4*a*) outward in the direction of the radius of the fan (6).

A line (A) connecting an air inlet end (41*a*) and an air outlet end (41*b*) of a board-shaped rib (41) in the cross section perpendicular to a line ($C_1$) formed by the air outlet end (41*b*) of the board-shaped rib (41) is inclined from the rotation axis (O–O') by a predetermined angle (θr) of installment in the direction of rotation of the fan (6).

In addition, a point ($P_2$) on the outer circumference of the air outlet end (41*b*) of the board-shaped rib (41) is positioned at a point rotated the direction of rotation of the fan (6) from a straight line (B) connecting a point ($P_1$) on the inner circumference of the air outlet end (41*a*) and the rotation axis (O–O').

In other words, the third invention comprises a frame (4*a*) arranged around the perimeter of the air outlet (2*a*) of the fan (6), and a plurality of board-shaped ribs (41, 41 . . . ) extending radially from the vicinity of the center of the frame (4*a*) corresponding to the rotation axis (O–O') of the fan (6) outward in the direction of the radius of the fan (6). In a cross section perpendicular to the line ($C_1$) formed by projecting the air outlet end (41*b*) of each of the plurality of board-shaped ribs (41, 41 . . . ) on a surface perpendicular to the rotation axis (O–O') of the fan (6), a line (A) connecting a point (PL) on the air inlet end (41*a*) of each of the plurality of board-shaped ribs (41, 41) and a point (PT) on the air outlet end (41*b*) is inclined from the rotation axis (O–O') of the fan (6) by a predetermined angle (θr) of installment in the direction of rotation of the fan (6). In addition, the point ($P_2$) closest to the frame (4*a*) on the line ($C_1$) formed by projecting the air outlet end (41*b*) of each of the plurality of board-shaped ribs (41, 41 . . . ) on a surface perpendicular to the rotation axis (O–O') of the fan (6) is positioned at a point rotated the direction of rotation of the fan (6) from the straight line (B) connecting a point of intersection (O) of the rotation axis (O–O') of the fan (6) and the projection surface and the point ($P_1$) closest to the center portion.

As stated before, there is a case where the air blowing unit is applied to the outer unit of an air-conditioning system. In this case, the occurrence of a short-circuit must be prevented as much as possible because it decreases the air-conditioning performance. The air taken in through the opening for air intake on the back side of the casing passes through a heat exchanger and then is blown off through the air outlet (2*a*) on the front side of the fan (6). It is necessary to avoid a phenomenon in which the flown air is again taken in through the opening for air intake and supplied to the heat exchanger. However, the current generated by the fan (6) arranged upstream of the fan guard (4) tends to flow outward in the direction of the radius of the fan (6). Consequently, if nothing is done, it is likely that the current from the fan guard (4) adheres to the surface of the front wall of the casing due to Coanda effect and travels towards the heat exchanger on the rear side, thereby causing a short circuit.

Therefore, the third invention comprises the plurality of board-shaped ribs (41) extending radially outward in the direction of the radius of the fan (6). The board-shaped ribs (41) are so shaped that the line (A) connecting an air inlet end (41*a*) and an air outlet end (41*b*) is inclined from the rotation axis (O–O'), and that the point ($P_2$) on the outer circumference of the air outlet end (41*b*) is positioned at a point rotated in the direction of rotation of the fan (6) from the point ($P_1$) on the inner circumference.

Employing ribs shaped like this makes a force (Fr) inward in the direction of the radius of the fan (6) due to the board-shaped ribs (41) act on the current generated by the fan (6). Consequently, the current from the fan guard (4) is prevented from flowing outward in the direction of the radius of the fan (6), which reduces the occurrence of a short circuit as much as possible.

Since the ribs (41) of the third invention are shaped like boards, the current generated by the fan (6) smoothly follows the surfaces of the board-shaped ribs (41). As a result, splitting of current occurs less, which eliminates the pressure loss and lowers the noise.

(4) Fourth Invention

The fourth invention is provided with a frame (4*a*) arranged around the perimeter of an air outlet (2*a*) of a fan (6), and further with a plurality of board-shaped ribs (41, 41 . . . ) extending radially from the vicinity of the center of the frame (4*a*) outward in the direction of the radius of the fan (6). The fourth invention is further provided with a plurality of nearly cylindrical ribs (42, 42 . . . ) which are integrated with the plurality of board-shaped ribs (41, 41 . . . ) and arranged concentrically around the rotation axis (O–O') of the fan (6) at predetermined intervals in the direction of the radius of the fan (6).

A line (A) connecting an air inlet end (41*a*) and an air outlet end (41*b*) of a board-shaped rib (41) in the cross section perpendicular to a line ($C_1$) formed by the air outlet end (41*b*) of the board-shaped rib (41) is inclined from the rotation axis (O–O') by a predetermined angle (θr) of installment in the direction of rotation of the fan (6).

In addition, a point ($P_2$) on the outer circumference of the air outlet end (41*b*) of the board-shaped rib (41) is positioned at a point rotated in the direction of rotation of the fan (6) from a straight line (B) connecting a point ($P_1$) on the inner circumference of the air outlet end (41*a*) and the rotation axis (O–O').

In other words, the fourth invention comprises a frame (4*a*) arranged around the perimeter of the air outlet (2*a*) of the fan (6), a plurality of board-shaped ribs (41, 41 . . . ) extending radially from the vicinity of the center of the frame (4*a*) corresponding to the rotation axis (O–O') of the fan (6) outward in the direction of the radius of the fan (6), and a plurality of nearly cylindrical ribs (42, 42 . . . ) which are integrated with the plurality of board-shaped ribs (41, 41 . . . ) and arranged concentrically around the rotation axis (O–O') of the fan (6) at predetermined intervals in the direction of the radius of the fan (6). In a cross section perpendicular to the line ($C_1$) formed by projecting the air outlet end (41*b*) of each of the plurality of board-shaped ribs (41, 41 . . . ) on a surface perpendicular to the rotation axis (O–O') of the fan (6), a line (A) connecting a point (PL) on the air inlet end (41*a*) of each of the plurality of board-shaped ribs (41, 41) and a point (PT) on the air outlet end (41*b*) is inclined from the rotation axis (O–O') of the fan (6) by a predetermined angle (θr) of installment in the direction of rotation of the fan (6). In addition, the point ($P_2$) closest to the frame (4*a*) on the line ($C_1$) formed by projecting the air outlet end (41*b*) of each of the plurality of board-shaped ribs (41, 41 . . . ) on a surface perpendicular to the rotation axis (O–O') of the fan (6) is positioned at a point rotated in the direction of rotation of the fan (6) from the straight line (B) connecting a point of intersection (O) of the rotation axis (O–O') of the fan (6) and the projection surface and the point ($P_1$) closest to the center portion.

As stated before, there is a case where the air blowing unit is applied to the outer unit of an air-conditioning system. In this case, the occurrence of a short-circuit must be prevented as much as possible because it decreases the air-conditioning performance. The air taken in through the opening for air intake on the back side of the casing passes through a heat exchanger and then is blown off through the air outlet (2*a*) on the front side of the fan (6). It is necessary to avoid a phenomenon in which the blown air is again taken in through the opening for air intake and supplied to the heat exchanger. However, the current generated by the fan (6) arranged upstream of the-fan guard (4) tends to flow outward in the direction of the radius of the fan (6). Consequently, if nothing is done, it is likely that the current from the fan guard (4) adheres to the surface of the front wall of the casing due to Coanda effect and travels towards the heat exchanger on the rear side, thereby causing a short circuit.

Therefore, the fourth invention comprises the plurality of board-shaped ribs (41) extending radially outward in the direction of the radius of the fan (6). The board-shaped ribs (41) are so shaped that the line (A) connecting the air inlet end (41*a*) and the air outlet end (41*b*) is inclined from the rotation axis (O–O'), and that the point ($P_2$) on the outer circumference of the air outlet end (41*b*) is positioned at a point rotated in the direction of rotation of the fan (6) from the point ($P_1$) on the inner circumference.

Employing the ribs shaped like this makes a force (Fr) inward in the direction of the radius of the fan (6) due to the board-shaped ribs (41) act on the current generated by the fan (6). Consequently, the current from the fan guard (4) is prevented from flowing outward in the direction of the radius of the fan (6), which reduces the occurrence of a short circuit as much as possible.

The fourth invention further comprises a plurality of nearly cylindrical ribs (42) which are integrated with the board-shaped ribs (41) and arranged concentrically. This structure makes the whole current in the direction of the radius of the fan (6) be converged forward due to the effect of the nearly cylindrical ribs (42) controlling the direction of the current. This prevents the occurrence of a short circuit further effectively.

As stated above, the current generated by the fan (6) and flowing into the fan guard (4) becomes spinning currents having a speed component in the direction of rotation of the fan (6). As a result, if the direction of the current generated by the fan (6) does not agree with the angle at which the board-shaped ribs (41) are installed, the current is split and noise occurs.

Therefore, in the fourth invention, the line (A) connecting the air inlet end (41*a*) and the air outlet end (41*b*) is inclined from the rotation axis (O–O') in the direction of rotation of the fan (6). As a result, the direction of the current from the fan (6) agrees with the angle at which the board-shaped ribs (41) are installed, which can reduce the splitting of the current as much as possible, thereby further lowering the noise.

Consequently, the plurality of board-shaped ribs (41) and the plurality of nearly cylindrical ribs (42) become approximately symmetrical with respect to the rotation axis (O–O'). This structure can more effectively restrict a pressure loss resulting from a current collision due to the disagreement of the direction of the current from the fan (6) and the angle at which the ribs are installed, or noise resulting from the occurrence of vortexes.

Since the ribs (41) of the fourth invention are shaped like boards, the current generated by the fan (6) smoothly follows the surfaces of the board-shaped ribs (41). As a result, splitting of current occurs less, which eliminates the pressure loss and lowers the noise.

(5) Fifth Invention

According to the fifth invention, in any of the first to fourth inventions, the inner dimension ($\psi_1$) of the frame (4*a*) is designed to be larger than the inner diameter ($\psi_2$) of the edge of the air outlet (2*a*) upstream of the fan guard (4).

When the inner dimension ($\psi_1$) of the frame (4*a*) is larger than the inner diameter ($\psi_2$) of the edge of the air outlet (2*a*) upstream of the fan guard (4), it becomes possible to prevent the current generated by the fan (6) from causing interference with the frame (4*a*). This structure further improves the effect of reducing noise in any of the first to fourth inventions.

(6) Sixth Invention

According to the sixth invention, in any of the first to fourth inventions, the line ($C_1$) formed by the air outlet end (41*b*) of each of the board-shaped ribs (41) is a curve where the angle ($\theta\alpha$) which the line ($C_1$) forms with the direction tangent to the nearly cylindrical ribs (42) grows from inside to outside in the direction of the radius of the fan (6).

In other words, according to the sixth invention, in any of the first to fourth inventions, the line ($C_1$) formed by projecting the air outlet end (41*b*) of each of the plurality of board-shaped ribs (41, 41 . . . ) is a curve where the angles ($\theta\alpha$, $\theta\alpha$. . . ) which the line ($C_1$) forms with the direction tangent to the plurality of nearly cylindrical ribs (42) grow from inside to outside in the direction of the radius of the fan (6).

This structure can prevent the force (Fr) (Refer to FIG. 6), which acts inwardly in the direction of the radius of the fan (6) from the board-shaped ribs (41), from becoming larger than necessary against the current from the fan (6), so as to increase the current resistance on the tip sides of the blades (6*b*, 6*b* . . . ) of the fan (6) which have a relatively large speed component in the axial direction.

(7) Seventh Invention

According to the seventh invention, in the sixth invention, the angle ($\theta r$) at which the board-shaped ribs (41) are installed is designed to be approximately equal to the angle ($\theta i$) at which air is generated by the fan (6) in the diametrical position (Rcmax) where the speed component (CZ) of the current from the fan (6) in the axial direction is the largest and is approximately uniform in the direction of the radius of the fan (6).

In other words, according to the seventh invention, in the sixth invention, the angle ($\theta r$) at which the board-shaped ribs (41) are installed is designed to be approximately equal to the angle ($\theta i$) of the current just generated by the blades of the fan (6) in the diametrical position (Rcmax) where the speed component (CZ) of the current from the blades of the fan (6) in the axial direction is the largest and is approximately uniform in the direction of the radius of the fan (6).

In the third, fourth, fifth, or sixth invention, the speed component of the current just generated by the fan (6) in the axial direction is lowered by a predetermined degree before it flows into the fan guard (4). On the other hand, due to law of conservation of angular momentum, the speed component of the current from the fan (6) in the circumferential direction is maintained at the opening of the fan guard (4). Consequently, the angle ($\theta n$) between the axial direction and the direction tangent to the current flowing into the fan guard (4) is larger than the angle ($\theta i$) of the current just generated by the fan (6).

In addition, the angle ($\theta i$) of the current just generated by the fan (6) tends to increase as it gets closer to the hub (6*a*) than in the diametrical position (Rcmax) where speed component (CZ) of the current from the fan (6) in the axial direction is the largest. Consequently, it is pretty difficult to design the angle ($\theta r$) of installment in a manner to make the angles ($\theta i$) and ($\theta n$) equal to each other.

Therefore, in the seventh invention, the angle ($\theta\alpha$) between the line ($C_1$) formed by the air outlet end (41*b*) of each of the board-shaped ribs (41) and the direction tangent to the nearly cylindrical ribs (42) is increased outward in the direction of the radius of the fan (6). Furthermore, the angle ($\theta r$) at which the board-shaped ribs (41) are installed is designed to be approximately equal to the angle ($\theta i$) of air flowing from the fan (6) in the position (Rcmax) where the speed component (CZ) of the current from the fan (6) in the axial direction is the largest.

As a result, the substantial angle (θrs) of installing the ribs with respect to the current from the fan (6) can be designed to approximately agree with the angle (θn) between the axial direction and the direction tangent to air flowing into the fan guard (4).

In that case, in the seventh invention, the angle (θr) at which the board-shaped ribs (41) are installed is approximately uniform in the direction of the radius of the fan (6). Consequently, the above-mentioned substantial angle (θrs) of installment becomes larger on the hub (6*a*) side than in the diametrical position (Rcmax) where the speed component (CZ) of the current from the fan (6) in the axial direction is largest, so that it agrees with air actually flowing into the fan guard (4).

Therefore, in the seventh invention, the effect of reducing noise can be obtained only by controlling the angle (θi) of the current in the diametrical position (Rcmax) where the speed component (CZ) of the current from the fan (6) in the axial direction is largest. Thus, only controlling the angle (θi) makes it possible that the substantial angle (θrs) of installment in all positions in the direction of the radius of the fan (6) agrees with the air current, without complicated setting of the angle (θr) at which the board-shaped ribs (41) are installed in the direction of the radius of the fan (6). As a result, the effect of reducing noise can be obtained by means of a simpler design.

(8) Eighth Invention

According to the eighth invention, in any of the first to fourth inventions, the number (Zr) of the board-shaped ribs (41) and the number (Zb) of the blades (6*b*) of the fan (6) are relatively prime, and when the midpoint position of the curve ($C_1$) formed by the air outlet end (41*b*) of each of the board-shaped ribs (41) and the midpoint position of the curve ($C_2$) formed by the rear edge of each of the blades (6*b*) of the fan (6) coincide with each other with respect to a surface perpendicular to the rotation axis (O–O'), these curves ($C_1$, $C_2$) are designed to cross each other.

In other words, according to the eighth invention, in any of the first to seventh inventions, the number (Zr) of the board-shaped ribs (41) and the number (Zb) of the blades (6*b*) of the fan (6) are relatively prime, and when the curve ($C_2$) formed by projecting the rear edge of each of the blades (6*b*, 6*b* . . . ) of the fan (6) is rotated in such a manner as to make the midpoint position of the curve ($C_2$) agree with the midpoint position of the curve ($C_1$) formed by projecting the air outlet end (41*b*) of each of the board-shaped ribs (41, 41 . . . ) on a surface perpendicular to the rotation axis (O–O') of the fan (6), these curves ($C_1$, $C_2$) are designed to cross each other.

In general, the current just generated by the fan (6) having a speed component in the direction of rotation of the fan is influenced by a boundary layer or a split region developed on the negative pressure surface of the blades (6*b*). Consequently, there are main stream portions having a current with high velocity among the blades (6*b*) and rear stream portions having a current with low velocity in the vicinity of each blade (6*b*). When seen from the plurality of board-shaped ribs (41, 41 . . . ) side while they are in a stationary state, the main stream portions and the rear stream portions of different velocities pass through the air inlet ends alternately. As a result, the surfaces of the board-shaped ribs (41) have a pressure fluctuation whose main component is a frequency corresponding to the product of the number of revolutions N of the fan (6) and the number (Zb) of the blades (6*b*), which causes so-called NZ noise.

However, in the eighth invention, the number (Zr) of the plurality of board-shaped ribs (41, 41 . . . ) and the number (Zb) of the blades (6*b*, 6*b* . . . ) are made to be relatively prime, thereby making it possible to shift in time the interference between the rear streams of the blades (6*b*) and the plurality of board-shaped ribs (41, 41 . . . ) arranged in the direction of the perimeter. As a result, the NZ noises have different phases in the direction of the radius of the fan (6), which makes the NZ noises weaken each other, so as to reduce the occurrence of the NZ noises.

On the other hand, when the curve ($C_2$) formed by projecting the rear edge of each of the blades (6*b*) of the fan (6) is rotated so as to coincide with the curve ($C_1$) formed by projecting the air outlet end (41*b*) of each of the board-shaped ribs (41) on a surface perpendicular to the rotation axis (O–O') of the fan (6), the NZ noises increase remarkably. In this case, the rear streams of the current from the fan (6) pass through the board-shaped ribs (41) in the direction of the radius of the fan (6). This remarkably increases the NZ noises resulting from the interference between the rear streams from the blades (6*b*) and the board-shaped ribs (41).

Therefore, in the eighth invention, when the midpoint position of the curve ($C_1$) of the air outlet end (41*b*) of each of the board-shaped ribs (41) agrees with the midpoint position of the curve ($C_2$) of the rear edge of each of the blades (6*b*) of the fan (6) with respect to a surface perpendicular to the rotation axis (O–O') of the fan (6), these curves ($C_1$, $C_2$) are designed to cross each other. This structure can shift in time the interference between the rear streams of the blades (6*b*) and the plurality of board-shaped ribs (41). As a result, the NZ noises have different phases in the direction of the radius of the fan (6), which makes the NZ noises weaken each other, so as to reduce the occurrence of the NZ noises.

Thus, according to the eighth invention, the fan guard (4) can be further thinned, while maintaining the effects of reducing noise and preventing the occurrence of a short circuit in any of the first to seventh inventions.

(9) Ninth Invention

According to the ninth invention, in any of the first to eighth inventions, the air inlet ends (41*a*, 42*a*) of the board-shaped ribs (41) or the nearly cylindrical ribs (42) are designed to be approximately arc in cross section.

In general, the current generated by the fan (6) fluctuates over time, so that the angle at which air flows into the board-shaped ribs (41) or the nearly cylindrical ribs (42) of the fan guard (4) also fluctuates over time.

Therefore, in the ninth invention, the ribs (41, 42) are designed to be approximately arc in cross section so that the pressure fluctuation on the rib surfaces can be reduced effectively even if the angle of air flowing into the board-shaped ribs (41) or the nearly cylindrical ribs (42) fluctuates.

Consequently, the structure of the ninth invention further improves the effect of reducing noise in any of the first to eighth inventions.

Furthermore, the angle of air flowing into the board-shaped ribs (41) or the nearly cylindrical ribs (42) of the fan guard (4) fluctuates greatly over time as it gets closer to the rear edges of the blades (6*b*) of the fan (6). Thus, in the present invention, the fan guard (4) can be designed to be thinner.

(10) Tenth Invention

According to the tenth invention, in any of the first to ninth inventions, the thickness ($T_2$) of the air outlet ends (41*b*, 42*b*) of the board-shaped ribs (41) or the nearly cylindrical ribs (42) is designed to be smaller than the maximum thickness ($T_1$).

Thus forming the cross sectional profiles of the board-shaped ribs (41) or the nearly cylindrical ribs (42) facilitates the mixing of current on the surfaces of the ribs (41, 42) which occurs immediately after the board-shaped ribs (41) or the nearly cylindrical ribs (42), thereby making it harder to develop vortexes behind the ribs (41, 42). As a result, the effects in any of the first to ninth inventions can be fully exerted even when it is necessary to increase the thickness of the ribs (41, 42) in order to provide enough strength.

(11) Eleventh Invention

According to the eleventh invention, in any of the first to tenth inventions, a sealing plate (43) is provided at the center of the frame (4*a*) corresponding to the rotation axis (O–O') of the fan (6).

In general, in the distribution of current in the direction of the radius of the fan (6) inside the hub (6*a*), there is a reverse current which goes from the downstream side of the fan (6) towards the hub (6*a*) side. The reverse current interferes with the current flowing in the intended direction, thereby causing an issue of noise.

In the eleventh invention, a sealing plate (43) is provided at the center of the fan guard (4) and is made to correspond to the rotation axis (O–O') of the fan (6). The sealing plate (43) covering the center of the fan guard (4) restricts the interference between the current flowing towards the air outlet and the reverse current, thereby further reducing the noises.

(12) Twelfth Invention

According to the twelfth invention, in any of the first to eleventh invention, the frame (4*a*) is designed to be approximately rectangular.

The current from the fan (6) varies in velocity among different positions in the direction of the radius of the fan (6). As stated above, the air flowing from the outer portions of the blades of the fan (6) that are a little closer to the hub (6*a*) than the tips of the blades has a higher velocity than the current from the tips. The velocity of the current decreases from these portions both towards the hub (6*a*) and towards the tips. The current shows such a velocity distribution in the direction of the radius of the fan (6).

In the twelfth invention, the frame (4*a*) of the fan guard (4) is approximately rectangular, and the current from the fan (6) is led to four corners. Above all, the velocity of flow of air from the outer portions of the blades (6*b*) of the fan (6) that are a little closer to the hub (6*a*) than the tips of the blades can be decreased effectively within a short distance.

The twelfth invention has a feature of increasing the effective area of the fan guard (4) when the casing of the air blowing unit is shaped like a rectangular box, thereby efficiently improving the effects of the fifth invention.

In this case, the fan guard (4) is usually installed in the downstream part of the circular air outlet (2*a*) arranged on one surface of the rectangular casing. Since the fan guard (4) is approximately rectangular, there is an advantage that the casing can be used without changing the outer dimensions.

(13) Thirteenth Invention

According to the thirteenth invention, in any of the first to twelfth inventions, the air inlet ends (42*a*) of the nearly cylindrical ribs (42) are more protruded than the air inlet ends (41*a*) of the board-shaped ribs (41).

When the blades (6*b*) of the fan (6) pass through the positions of the board-shaped ribs (41), it is inevitable that some vortexes occur on each surface of the board-shaped ribs (41). On the other hand, the nearly cylindrical ribs (42), which are along the current from the fan (6), cause almost no vortexes.

However, when the air inlet ends (41*a*) of the board-shaped ribs (41) are more protruded than the air inlet ends (42*a*) of the nearly cylindrical ribs (42), vortexes occur at the air inlet ends (42*a*) of the nearly cylindrical ribs (42) in the portions where the board-shaped ribs (41) and the nearly cylindrical ribs (42) cross each other.

Therefore, in the present invention, the air inlet ends (42*a*) of the nearly cylindrical ribs (42) are more protruded than the air inlet ends (41*a*) of the board-shaped ribs (41) so as to prevent the occurrence of vortexes at the air inlet ends (42*a*) of the nearly cylindrical ribs (42). Consequently, noises caused by the occurrence of the vortexes can be prevented.

(14) Fourteenth Invention

According to the fourteenth invention, in any of the first to thirteenth inventions, the air inlet ends (42*a*) of the nearly cylindrical ribs (42) are more protruded than the air inlet ends (41*a*) of the board-shaped ribs (41), and the air outlet ends (42*b*) of the nearly cylindrical ribs (42) are more protruded than the air outlet ends (41*b*) of the board-shaped ribs (41).

The fan guard is usually molded by pulling out two molds in the direction of the air inlet ends (41*a*, 42*a*) and the air outlet ends (41*b*, 42*b*) of the board-shaped ribs (41) and the nearly cylindrical ribs (42).

In this case, if the air inlet ends (41*a*) and the air outlet ends (41*b*) of the board-shaped ribs (41) were more protruded than the air inlet ends (42*a*) and the air outlet ends (42*b*) of the nearly cylindrical ribs (41), undercut or other problems would occur at the portions where the board-shaped ribs (41) and the nearly cylindrical ribs (42) cross each other. As a result, it would take time to mold the fan guard (4).

Therefore, in the present invention, the molding is facilitated by making the air inlet ends (42*a*) and the air outlet ends (42*b*) of the nearly cylindrical ribs (42) be more protruded than the air inlet ends (41*a*) and the air outlet ends (41*b*) of the board-shaped ribs (41).

(15) Fifteenth Invention

The fifteenth invention relates to an air-conditioning device provided with the fan guard (4) of the air blowing unit of any of the first to fourteenth inventions. The air-conditioning device is provided with a heat source side unit (50) and a user's side unit, and the heat source side unit (50) includes at least a heat exchanger and a fan stored in a casing (51). The casing (51) is provided with an air outlet (54), which is covered by the fan guard (4).

The fifteenth invention is an air-conditioning device which can exert the effects of any of the first to fourteenth inventions. The air-conditioning device of the present invention prevents the occurrence of a short circuit effectively, which secures prevention of a decrease in air conditioning performance.

The provision of the nearly cylindrical ribs (42) makes the whole current in the direction of the radius of the fan (6) be converged forward due to the effect of the nearly cylindrical ribs (42) controlling the direction of the current. This prevents the occurrence of a short circuit further effectively.

The splitting of the current at the fan guard (4) occurs less, which eliminates the pressure loss and lowers the noise.

The NZ noises in the fan guard (4) have different phases in the direction of the radius of the fan (6), which makes the NZ noises weaken each other, so as to reduce the occurrence of the NZ noises.

Making the air inlet ends (41*a*, 42*a*) of the board-shaped ribs (41) or the nearly cylindrical ribs (42) approximately arc in cross section, the fan guard (4) can be designed further thinner.

Providing the sealing plate (43) at the center of the fan guard (4) restricts the interference between air flowing towards the air outlet and the reverse current, thereby further reducing the noises.

In the case where the casing (51) is shaped like a rectangular box, designing the frame (4*a*) to be approximately rectangular can increase the effective area of the fan guard (4).

BEST MODE FOR CARRYING OUT THE INVENTION

Embodiment 1

FIGS. 1 through 14 show the fan guard of Embodiment 1 of the present invention, which is used in an air blowing unit such as the outdoor unit of an air-conditioning device.

Figure 1:
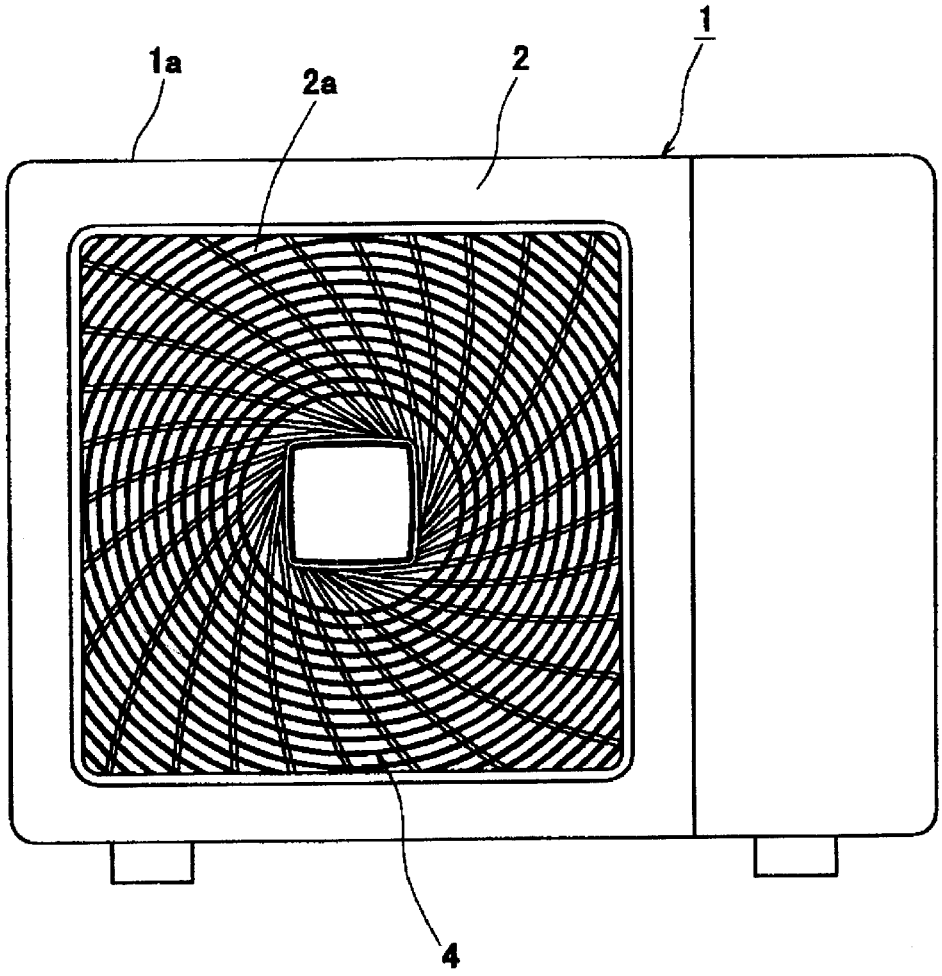
FIG. 1 is a front view of the air blowing unit of Embodiment 1 of the present invention.
Figure 2:
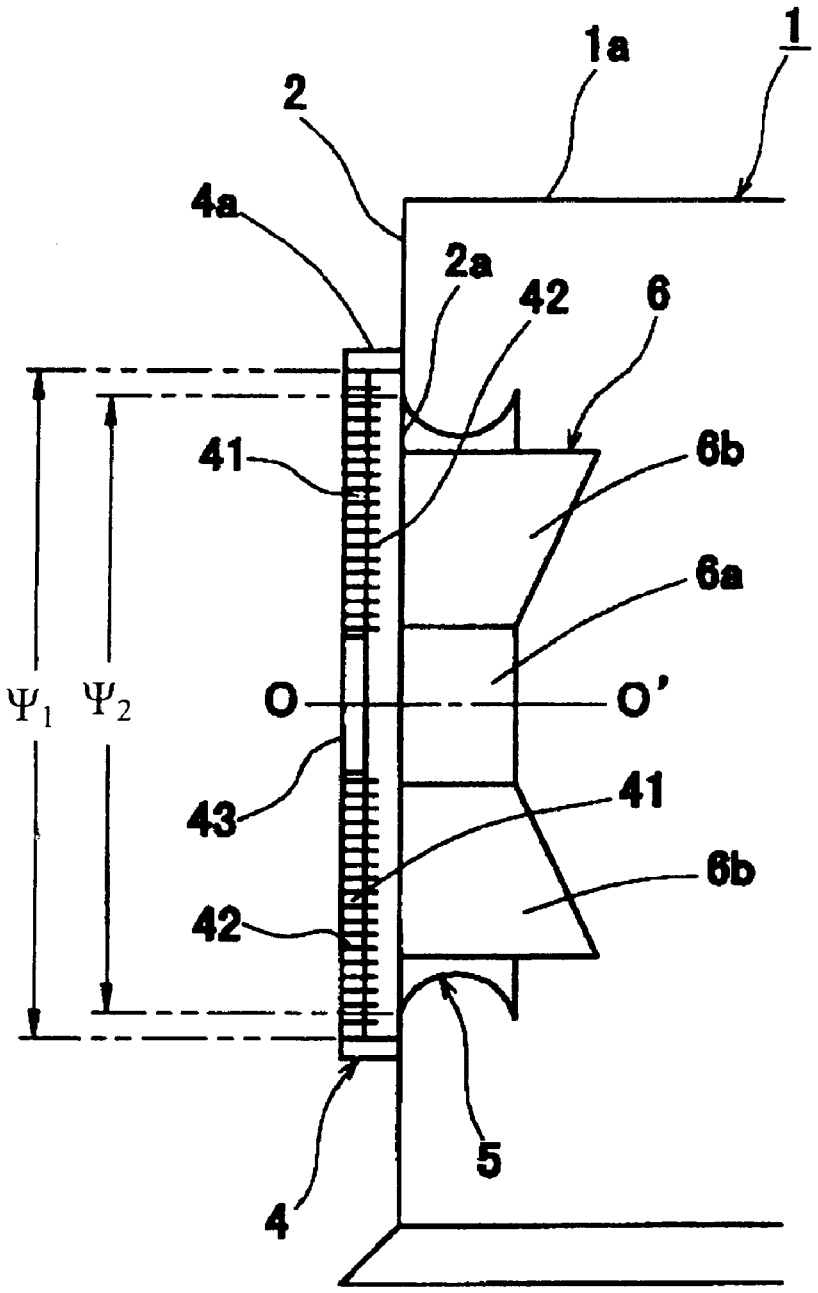
FIG. 2 is a cross sectional view of the structure showing the fan guard of Embodiment 1.

As an air blowing unit, the present embodiment employs an outdoor unit (1) of an air-conditioning device similar to the above-described outdoor unit of the prior art example. As shown in FIGS. 1 and 2, the outdoor unit (1) is composed of a heat exchanger (not shown) and a fan (6) made of a propeller fan which are laid from the opening (not shown) for air intake on the rear side towards the air outlet (2*a*) inside a casing (1*a*). On the front side (2) of the casing (1*a*), a fan guard (4) for protecting the fan (6) is provided to cover the air outlet (2*a*) formed by a bell mouth (5), which is a fan guide.

Rotating the fan (6) causes air to be taken into the casing (1*a*) through the opening for air intake. The air passed through the heat exchanger is changed into a current spinning in the direction of rotation of the fan (6), and is blown out through the bell mouth (5), the air outlet (2*a*), and the fan guard (4) in this order towards the front of the outdoor unit (1).

Figure 3:
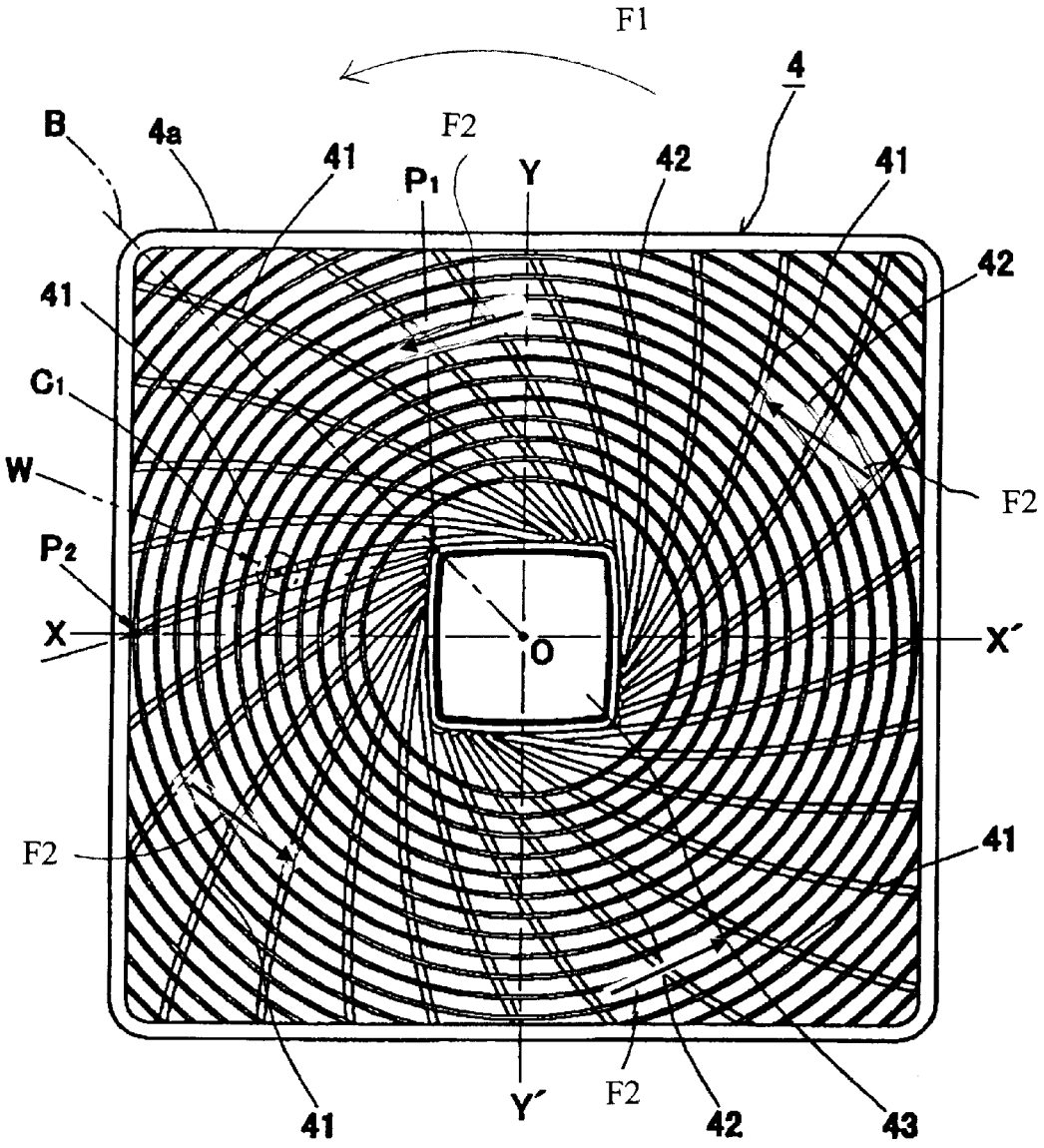
FIG. 3 is an enlarged front view of the fan guard of Embodiment 1.
Figure 4:
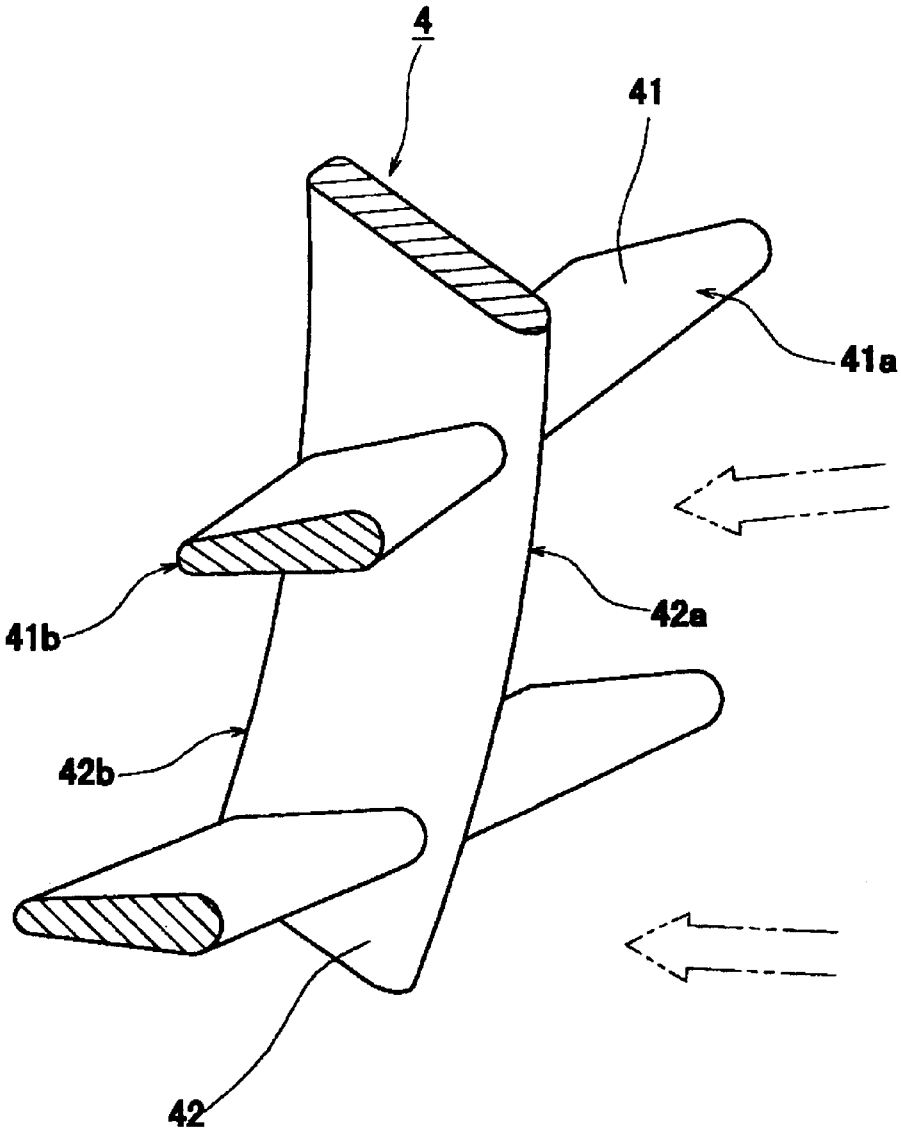
FIG. 4 is an enlarged perspective view of the main part of the fan guard of Embodiment 1.

The fan guard (4), as shown in FIGS. 3 and 4, comprises a frame (4*a*), a sealing plate (43), a plurality of broad-shaped ribs (41, 41 . . . ), and a plurality of cylindrical ribs (42, 42 . . . ).

The frame (4*a*) is arranged in the perimeter of the air outlet (2*a*) and is approximately rectangular.

The sealing plate (43) is so arranged that its center approximately coincides with the rotation axis (O–O') of the fan (6). The sealing plate (43) covers the center regions of the fan guard (4) and is appropriately rectangular like the frame (4*a*).

The board-shaped ribs (41) are extended radially outward in the direction of the radius of the fan (6) from the perimeter of the sealing plate (43).

The cylindrical ribs (42) are integrated with the plurality of board-shaped ribs (41, 41 . . . ). The plurality of cylindrical ribs (42, 42 . . . ) are arranged concentrically around the rotation axis (O–O') of the fan (6) at predetermined intervals in the direction of the radius of the fan (6). The cylindrical ribs (42) are in the form of short cylinders. The cylindrical ribs (42) of the present invention are not necessarily right circular cylinders; they can be nearly cylindrical.

In a vertical cross section of a board-shaped rib (41), a line (A) connecting an air inlet end (41*a*), which is the end of the air inlet side, and an air outlet end (41*b*), which is the end of the air outlet side is inclined from the rotation axis (O–O') by a predetermined angle ($\theta r$) of installment in the direction of rotation of the fan (6).

Figure 5:
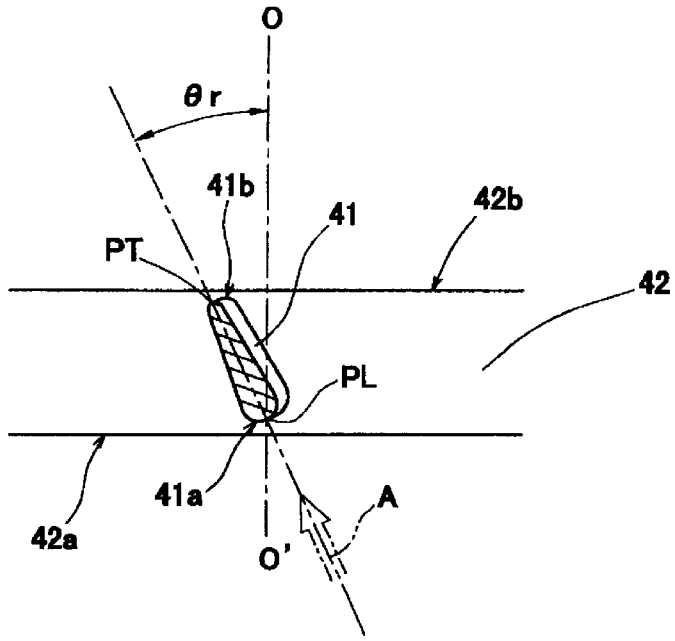
FIG. 5 is a partial perspective view showing the angle at which the board-shaped ribs are installed in Embodiment 1.

In a cross section perpendicular to the line ($C_1$) formed by projecting the air outlet end (41*b*) of each of the plurality of board-shaped ribs (41) on a surface perpendicular to the rotation axis (O–O') of the fan (6), as shown in FIG. 5, a line (A) connecting a point (PL) on the air inlet end (41*a*) of each of the plurality of board-shaped ribs (41) and a point (PT) on the air outlet end (41*b*) is inclined from the rotation axis (O–O') of the fan (6) by a predetermined angle ($\theta r$) of installment in the direction of rotation of the fan (6).

In addition, a point ($P_2$) on the outer circumference of the air outlet ends (41*b*) of the board-shaped ribs (41) is positioned at a point rotated in the direction of rotation of the fan (6) from a straight line (B) connecting a point ($P_1$) on the inner circumference of the air outlet ends (41*a*) and the rotation axis (O–O').

Thus, the point ($P_2$) closest to the frame (4*a*) on the line ($C_1$) formed by projecting the air outlet end (41*b*) of each of the plurality of board-shaped ribs (41) on a surface perpendicular to the rotation axis (O–O') of the fan (6) is positioned at a pint rotated in the direction of rotation of the fan (6) from the straight line (B) connecting a point of intersection (O) of the rotation axis (O–O') of the fan (6) and the projection surface and the point ($P_1$) on the inner circumference on the sealing plate (43) side.

On the other hand, the cylindrical ribs (42) are extended in such a manner as to be approximately uniform in diameter from the upstream side to the downstream side of the current. The air inlet ends (42*a*), which are the ends of the air inlet side of the cylindrical ribs (42) are formed to be arc having a large curvature.

The board-shaped ribs (41) are so formed that the air inlet ends (41*a*) have a large thickness, and the thickness is gradually reduced as it gets closer to the air outlet ends (41*b*). The air inlet ends (41*a*) and the air outlet ends (41*b*) are designed to be arc of a predetermined curvature (Refer to FIG. 4).

These plurality of board-shaped ribs (41) and the plurality of cylindrical ribs (42) are integrally made from a synthetic resin in such a manner as to cross each other as shown in FIG. 4.

As described above, the air blown from the fan (6) and flowing into the fan guard (4) generally becomes spinning currents having a predetermined speed component in the direction of rotation of the fan (6). In contrast, in the present embodiment, a plurality of cylindrical ribs (42) arranged concentrically around the rotation axis (0–0') of the fan (6) and at predetermined intervals in the direction of the radius of the fan (6) and a plurality of board-shaped ribs (41) extending radially outward in the direction of the radius of the fan (6) from the outer circumference of the sealing plate (43) are arranged approximately symmetrical with respect to the axis. This structure can more effectively restrict a pressure loss resulting from a current collision due to the disagreement of the direction of the current from the fan (6) and the angle at which the ribs (41, 42) are installed, or noise resulting from the occurrence of vortexes.

The current from the fan (6) varies in velocity among different positions in the direction of the radius of the fan (6). As stated above, air flowing from the outer portions of the blades of the fan (6) that are a little closer to the hub (6*a*) than the tips of the blades (6*b*, 6*b* . . . ) has a higher velocity than the current from the tips (Refer to FIG. 13). With regard to this problem, in the present embodiment, the frame (4*a*) of the fan guard (4) is designed to be approximately rectangular as described above. As a result, the current from the fan (6) is led to the four corners of the fan guard (4), and in particular, the velocity of the current from the outer portions of the blades (6*b*) of the fan (6) that are a little closer to the hub (6*a*) than the tips of the blades can be decreased effectively within a short distance.

It is generally known that the pressure loss of a fluid increases in proportion to the square of the velocity of flow of air, and that noise caused from a flat plate laid in a current is in proportion to the fifth or sixth power of an air velocity. Consequently, this structure makes it possible to reduce the pressure loss in the fan guard (4), fan noise resulting from a decrease in the number of revolutions of the fan (6), and noise caused by the ribs themselves.

The fan guard (4) of the air blowing unit like the outdoor unit of the air-conditioning device is usually installed downstream of the round air outlet (2*a*) arranged on the front surface (2) of the box-shaped rectangular casing (1*a*) as illustrated. When the frame (4*a*) is approximately rectangular, there is an advantage that the casing (1*a*) can be used without changing its outer dimensions.

In the present embodiment, in a cross section perpendicular to the line ($C_1$) formed by projecting the air outlet end (41*b*) of each of the plurality of board-shaped ribs (41) on a surface perpendicular to the rotation axis (O–O') of the fan (6), a line (A) connecting a point (PL) on the air inlet end (41*a*) of each of the plurality of board-shaped ribs (41) and a point (PT) on the air outlet end (41*b*) is inclined from the rotation axis (O–O') of the fan (6) by a predetermined angle (θr) of installment in the direction of rotation of the fan (6). Consequently, the direction of air flowing from the fan (6) and the angle at which the board-shaped ribs (41) are installed can be agreed with each other, so as to reduce the splitting of current resulting from their disagreement as much as possible, thereby further reducing the noise.

As for the distribution of air flowing from the fan (6) inside the outer diameter of the hub (6*a*) in the direction of the radius of the fan (6), there is a reverse current which goes from the downstream side of the fan (6) towards the hub (6*a*) side. The reverse current interferes with the current flowing in the intended direction, thereby causing an issue of noise.

In the present embodiment, the central position of the sealing plate (43) provided at the center of the fan guard (4) approximately coincides with the rotation axis (O–O') of the fan (6). Consequently, the sealing plate (43) covering the center of the fan guard (4) can restrict the interference between the current flowing in the intended direction and the reverse current, thereby further reducing the noises.

As described above, in a case where the air blowing unit is applied to the outer unit (1) of an air-conditioning system, the occurrence of a short-circuit must be prevented as much as possible because it decreases the air-conditioning performance. The short-circuit is a phenomenon where the air which has been taken in through the opening for air intake on the back side of the casing (1*a*) and passed through a heat exchanger is blown off through the air outlet (2*a*) on the front side of the fan (6) and is again taken in through the opening for air intake to be supplied to the heat exchanger. However, the current from the fan (6) arranged upstream of the fan guard (4) tends to flow outward in the direction of the radius of the fan (6). Consequently, if nothing is done, it is likely that the current from the fan guard (4) adheres to the surface of the front wall of the casing due to Coanda effect and travels towards the heat exchanger on the rear side, thereby causing a short circuit. Therefore, in the present embodiment, in a cross section perpendicular to the line ($C_1$) formed by projecting the air outlet end (41*b*) of each of the plurality of board-shaped ribs (41) on a surface perpendicular to the rotation axis (O–O') of the fan (6), a line (A) connecting a point (PL) on the air inlet end (41*a*) of each of the plurality of board-shaped ribs (41) and a point (PT) on the air outlet end (41*b*) is inclined from the rotation axis (O–O') of the fan (6) by a predetermined angle (θr) of installment in the direction of rotation of the fan (6) (Refer to FIG. 5). In addition, the point ($P_2$) closest to the frame (4*a*) on the line ($C_1$) formed by projecting the air outlet end (41*b*) of each of the plurality of board-shaped ribs (41) on a surface perpendicular to the rotation axis (O–O') of the fan (6) is positioned at a point rotated in the direction of rotation of the fan (6) from the straight line (B) connecting a point of intersection (O) of the rotation axis (O–O') of the fan (6) and the projection surface and the point ($P_1$) closest to the sealing plate (43).

Figure 6:
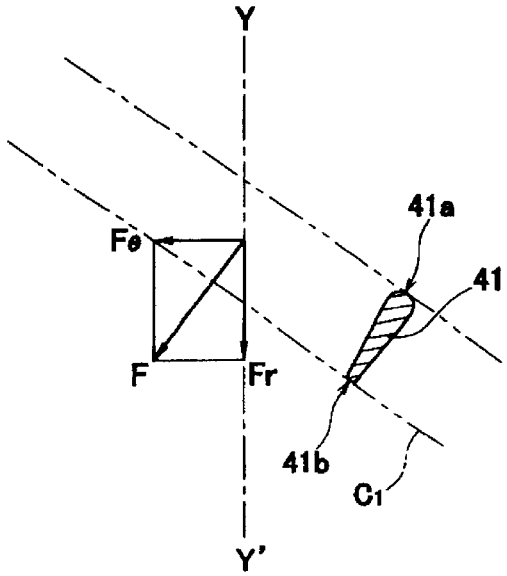
FIG. 6 is a view showing the speed component (Fr) of the current inward in the direction of the radius of the fan at the board-shaped ribs of Embodiment 1.

Employing the ribs shaped like this makes a force (Fr) inward in the direction of the radius of the fan (6) due to the board-shaped ribs (41) act on the current generated by the fan (6) as shown in FIG. 6. Consequently, the current from the fan guard (4) is prevented from flowing outward in the direction of the radius of the fan (6), which reduces the occurrence of a short circuit as much as possible.

In the fan guard (4) of the present embodiment, the inner dimension ($\psi_1$) of the frame (4*a*) is designed larger than the inner diameter ($\psi_2$) of the air outlet end of the bell mouth (5) arranged on the perimeter of the upstream side fan (6) of the fan guard (4), that is, of the edge of the air outlet (2*a*) on the air outlet side (Refer to FIG. 2).

In short, the inner dimension ($\psi_1$) which is the length of one side of the frame (4*a*) is designed larger than the inner diameter ($\psi_2$) of the bell mouth (5).

Making the inner dimension ($\psi_1$) of the frame (4*a*) larger than the inner diameter ($\psi_2$) of the edge of the air outlet (2*a*) can prevent the interference between the current from the fan (6) and the frame (4*a*) of the fan guard (4). It can also improve the effect of lowering the velocity of flow of air by the frame (4*a*), thereby further improving the effect of reducing noise.

In the case where the casing (1*a*) is shaped like a rectangular box, designing the frame (4*a*) of the fan guard (4) to be approximately rectangular can increase the effective area of the fan guard (4), thereby effectively improving the effect of reducing noises.

Figure 7:
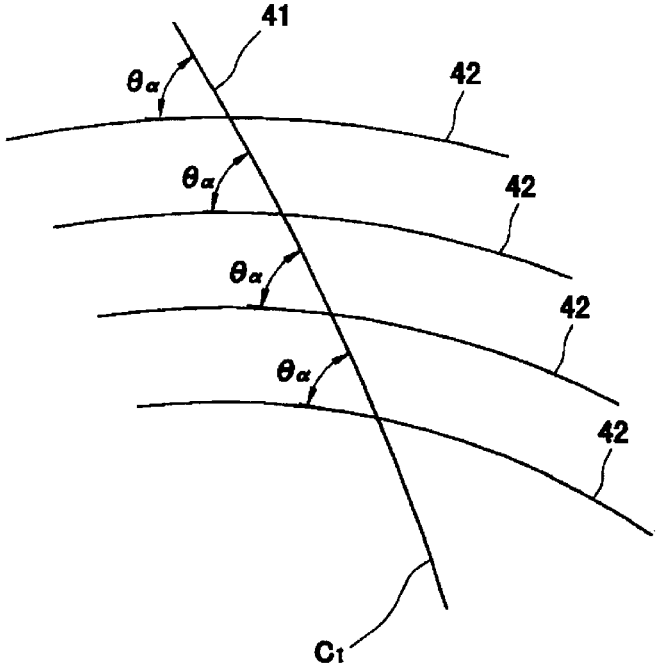
FIG. 7 is a view showing the angle ($\theta\alpha$) between the line ($C_1$) formed by the air outlet end of each of the board-shaped ribs and the direction tangent to the nearly cylindrical ribs in Embodiment 1.

In addition to the above features, the fan guard (4) of the present embodiment has another feature that as shown in FIG. 7, the angle ($\theta\alpha$) between the line ($C_1$) formed by the air outlet end (41*b*) of each of the board-shaped ribs (41) and the direction tangent to the cylindrical ribs (42) is increased outward in the direction of the radius of the fan (6).

In other words, the line ($C_1$) formed by projecting the air outlet end (41*b*) of each of the plurality of board-shaped ribs (41, 41 . . . ) is a curve where the angles ($\theta\alpha$, $\theta\alpha$. . . ) which the line ($C_1$) forms with the direction tangent to the plurality of cylindrical ribs (42) grow from inside to outside in the direction of the radius of the fan (6).

This structure can prevent the force (Fr) (Refer to FIG. 6), which acts inwardly in the direction of the radius of the fan (6) from the board-shaped ribs (41), from becoming larger than necessary against the current from the fan (6), so as to increase the blowing resistance on the tip sides of the blades (6*b*, 6*b* . . . ) of the fan (6) which have a relatively large speed component in the axial direction.

The angle ($\theta r$) at which the board-shaped ribs (41) are installed is designed to be approximately equal to the angle ($\theta i$) at which air flows from the fan (6) in the diametrical position (Rcmax) where the speed component (CZ) of the current from the fan (6) in the axial direction is the largest and is approximately uniform in the direction of the radius of the fan (6). In other words, the angle ($\theta r$) at which the board-shaped ribs (41) are installed (Refer to FIG. 5) is designed to be approximately equal to the angle ($\theta i$) (Refer to FIG. 8) of the current just generated by the fan (6) in the position (Rcmax) (Refer to FIG. 13) in the direction of the radius of the fan (6) where the speed component ($Cz_2$) of the current from the fan (6) in the axial direction is the largest and is approximately uniform in the direction of the radius of the fan (6).

Figure 8:
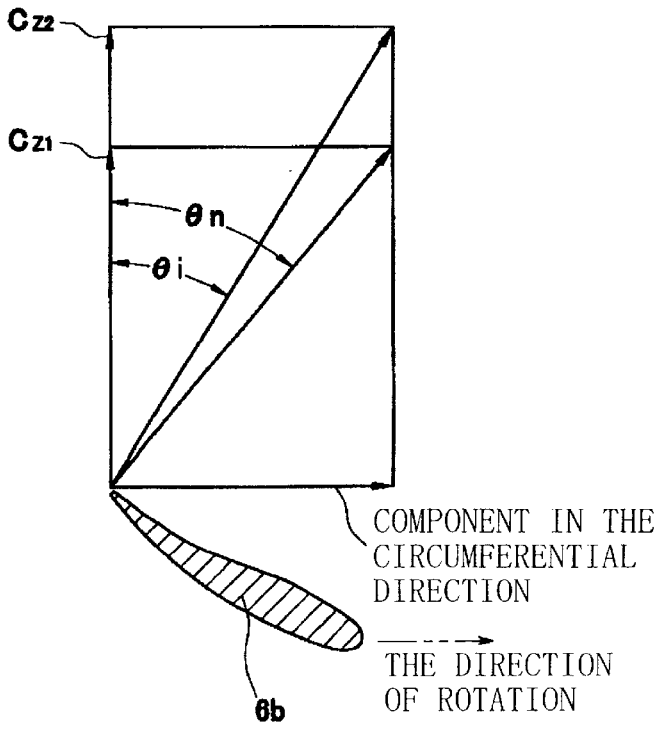
FIG. 8 is a view showing the relationship among the speed component ($Cz_2$) of the current just generated by the fan in the axial direction, the speed component ($Cz_1$) of air flowing into the fan guard in the axial direction, and the component of the current in the circumferential direction.
Figure 14:
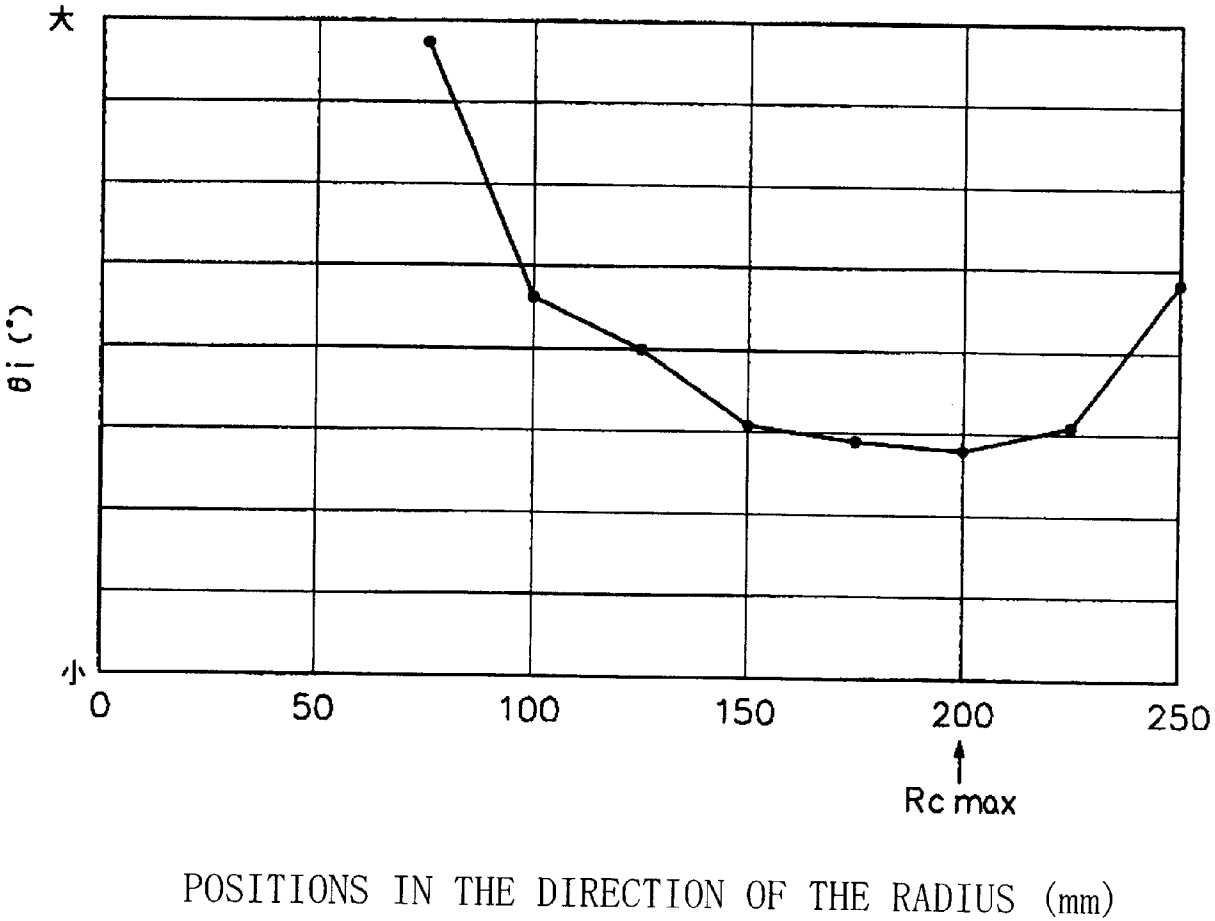
FIG. 14 is a graph showing the distribution of the angle of the current just generated by the fan in the air blowing unit in the direction of the radius of the fan (6).

As stated above, the speed component of the current just generated by the fan (6) in the axial direction is lowered by a predetermined degree before it flows into the fan guard (4). On the other hand, as shown in FIG. 8, due to law of conservation of angular momentum, the speed component of the current from the fan (6) in the circumferential direction is maintained at the opening of the fan guard (4). Consequently, the angle ($\theta n$) between the axial direction and the direction tangent to the current flowing into the fan guard (4) is larger than the angle ($\theta i$) of the current just generated by the fan (6). In addition, as shown in FIG. 14, the angle ($\theta i$) of the current just generated by the fan (6) tends to increase as it gets closer to the hub (6*a*) than in the position (Rcmax) (Refer to FIG. 13, too) in the direction of the radius of the fan (6) where the speed component ($Cz_2$) in the axial direction of the current from the fan (6) is the largest. Consequently, it is pretty difficult to design the angle ($\theta r$) of installment in a manner to make the angles ($\theta i$) and ($\theta n$) equal to each other.

Therefore, in the present embodiment, the curve ($C_1$) formed by projecting the air outlet end (41*b*) of each of the plurality of board-shaped ribs (41) on a surface perpendicular to the rotation axis of the fan (6) is a curve where the angles ($\theta\alpha$) (Refer to FIG. 7) which the curve ($C_1$) forms with the direction tangent to the plurality of cylindrical ribs (42) grow from inside to outside in the direction of the radius of the fan (6). Furthermore, in the present embodiment, the angle ($\theta r$) at which the board-shaped ribs (41) are installed (Refer to FIGS. 5 and 9) is designed to be approximately equal to the angle ($\theta i$) (Refer to FIG. 8) of the current in the diametrical position (Rcmax) where the speed component ($Cz_2$) of the current from the fan (6) in the axial direction is the largest.

Figure 9:
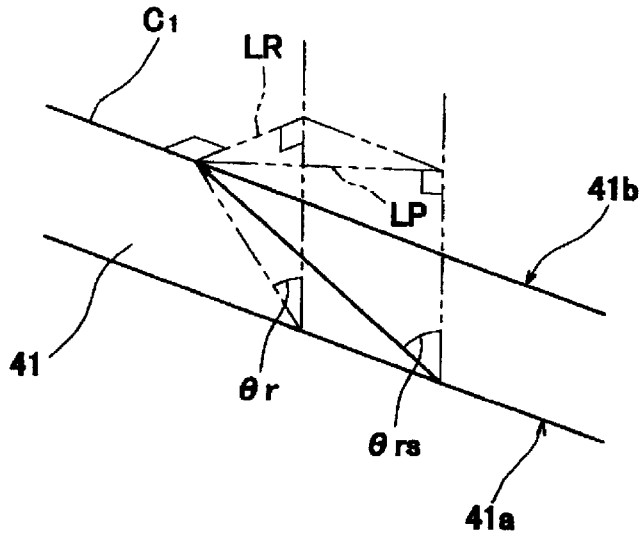
FIG. 9 is a view showing the relationship between the board-shaped ribs and the actual current in Embodiment 1.

As a result, as shown in FIG. 9, in the diametrical position (Rcmax) where the speed component ($Cz_2$) of the current from the fan (6) in the axial direction is the largest, the substantial angle ($\theta rs$) at which the ribs are installed against the current from the fan (6) can be designed to approximately agree with the angle ($\theta n$) (Refer to FIG. 8) between the axial direction and the direction tangent to the current flowing into the fan guard (4).

In that case, the curve ($C_1$) is a curve where the angles ($\theta\alpha$) which the curve ($C_1$) forms with the direction tangent to the plurality of cylindrical ribs (42) grow from inside to outside in the direction of the radius of the fan (6), and the angle ($\theta r$) at which the board-shaped ribs (41) are installed is approximately uniform in the direction of the radius of the fan (6). Consequently, the above-mentioned substantial angle ($\theta rs$) of installment becomes larger on the hub (6*a*) side than in the diametrical position (Rcmax) where the speed component ($Cz_2$) of the current from the fan (6) in the axial direction is largest, so that it agrees with the current actually flowing into the fan guard (4) (Refer to FIG. 9).

As shown in FIG. 9, the cylindrical ribs (42) are curved in the outward direction which is the centrifugal direction and also inclined in a surface perpendicular to the curve ($C_1$). As a result, air diagonally runs the length of the cylindrical ribs (42). The cylindrical ribs (42) have a larger curvature outside than in the center, so that the angle of inclination (the substantial angle $\theta rs$ of installment) of the cylindrical ribs (42) becomes larger on the hub (6*a*) side in the direction tangent to the circle with the rotation axis (O–O') as its center.

Therefore, the effect of reducing noise can be obtained only by controlling the angle ($\theta i$) of the current in the diametrical position (Rcmax) where the speed component (CZ) of the current from the fan (6) in the axial direction is largest. Thus, controlling only the angle ($\theta i$) makes it possible that the substantial angle ($\theta rs$) of installment in all positions in the direction of the radius of the fan (6) agrees with the air current, without complicated setting of the angle ($\theta r$) at which the board-shaped ribs (41) are installed in the direction of the radius of the fan (6). As a result, the effect of reducing the noise can be obtained by a simpler design. In FIG. 9, LR indicates a line perpendicular to the curve ($C_1$), and LP indicates a line parallel to the direction tangent to the cylindrical ribs (42).

Furthermore, in the present embodiment, the number (Zr) of the board-shaped ribs (41) and the number (Zb) of the blades (6*b*) of the fan (6) are relatively prime, and when the midpoint position of the curve ($C_1$) formed by the air outlet end (41*b*) of each of the board-shaped ribs (41) and the midpoint position of the curve ($C_2$) formed by the rear edge of each of the blades (6*b*) of the fan (6) coincide with each other with respect to a surface perpendicular to the rotation axis (O–O'), these curves ($C_1$, $C_2$) are designed to cross each other.

Figure 10:
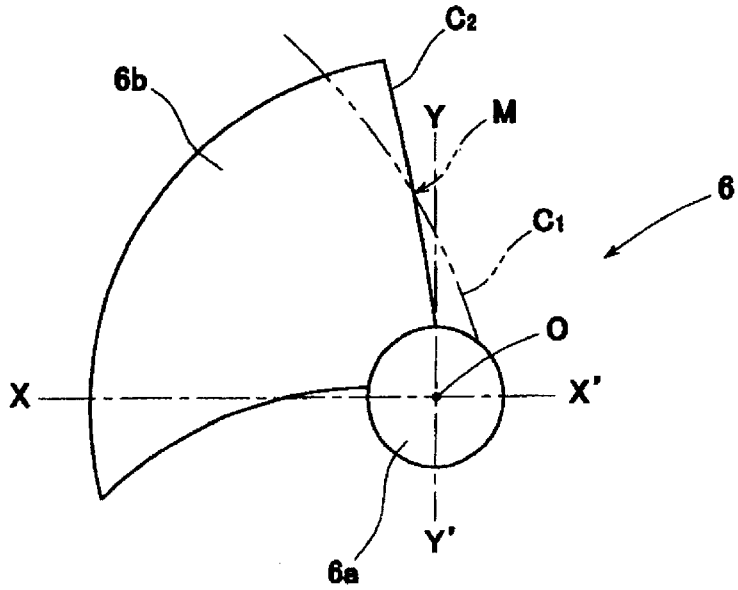
FIG. 10 is a view showing the relationship between the curve ($C_1$) formed by projecting each of the board-shaped ribs and the curve ($C_2$) formed by projecting each of the rear edges of the blades of the fan in Embodiment 1.

Thus, since the number (Zr) of the board-shaped ribs (41) and the number (Zb) of the blades (6*b*) of the fan (6) are relatively prime, the number (Zr) of the board-shaped ribs (41) does not agree with a multiple of the number (Zb) of the blades (6*b*) of the fan (6). Moreover, as shown in FIG. 10, when the curve ($C_2$) formed by projecting each of the rear edge of the blades (6*b*, 6*b* . . . ) of the fan (6) is rotated in such a manner as to make the midpoint position of the curve ($C_2$) agree with the midpoint position of the curve ($C_1$) formed by projecting the air outlet end (41*b*) of each of the board-shaped ribs (41) on a surface perpendicular to the rotation axis (O–O') of the fan (6), these curves ($C_1$, $C_2$) cross each other.

In general, the current just generated by the fan (6) having a speed component in the direction of rotation of the fan is influenced by a boundary layer or a split region developed on the negative pressure surface of the blade (6*b*). Consequently, there are main stream portions having a current with high velocity among the blades (6*b*, 6*b* . . . ) and rear stream portions having a current with low velocity in the vicinity of each of the blade (6*b*, 6*b* . . . ). When seen from the plurality of board-shaped ribs (41) side while they are in a stationary statei the main stream portions and the rear stream portions of different velocities pass through the air inlet ends (41*a*) alternately. As a result, the surfaces of the board-shaped ribs (41) have a pressure fluctuation whose main component is a frequency corresponding to the product of the number of revolutions N of the fan (6) and the number (Zb) of the blades (6*b*, 6*b* . . . ), which causes so-called NZ noise.

However, in the present embodiment, the number (Zr) of the plurality of board-shaped ribs (41) and the number (zb) of the blades (6*b*) are made to be relatively prime, thereby making it possible to shift in time the interference between the rear streams of the blades (6*b*) and the plurality of board-shaped ribs (41) arranged in the circumferential direction. As a result, the NZ noises have different phases in the direction of the radius of the fan (6), which makes the NZ noises weaken each other, so as to reduce the occurrence of the NZ noises.

On the other hand, when the curves ($C_1$, $C_2$) are designed to coincide with each other, the NZ noises increase remarkably. To be more specific, when the curve ($C_2$) formed by projecting the rear edge of each of the blades (6*b*) of the fan (6) is rotated so as to coincide with the curve ($C_1$) formed by projecting the air outlet end (41*b*) of each of the board-shaped ribs (41) on a surface perpendicular to the rotation axis (O–O') of the fan (6), the rear streams of the current from the fan (6) pass through the board-shaped ribs (41) in the direction of the radius of the fan (6). This remarkably increases the NZ noises resulting from the interference between the rear streams from the blades (6*b*) and the board-shaped ribs (41).

Therefore, in the present embodiment, the curve ($C_1$) and the curve ($C_2$) are designed to cross each other. To be more specific, the curve ($C_1$) and the curve ($C_2$) cross each other when the curve ($C_2$) is rotated so that the midpoint position of the curve ($C_1$) formed by projecting the air outlet end (41*b*) of each of the board-shaped ribs (41) on a surface perpendicular to the rotation axis (O–O') of the fan (6) agrees with the midpoint position of the curve ($C_2$) formed by projecting the rear edge of each of the blades (6*b*) of the fan (6) on a surface perpendicular to the rotation axis (O–O') of the fan (6).

This structure can shift in time the interference between the rear streams of the blades (6*b*) and the plurality of board-shaped ribs (41). As a result, the NZ noises have different phases in the direction of the radius of the fan (6), which makes the NZ noises weaken each other, so as to reduce the occurrence of the NZ noises.

Thus, according to the above-described structure, the fan guard (4) can be further thinned, while maintaining the effects of reducing the noises and preventing the occurrence of a short circuit.

As shown in FIG. 4, in the fan guard (4) of the present embodiment, the board-shaped ribs (41) are designed to be arc in cross section at the air inlet ends (41*a*) and the air outlet ends (41*b*), and to be gradually thinner in the direction from the air inlet ends (41*a*) towards the air outlet ends (41*b*).

The air inlet ends (41*a*) of the board-shaped ribs (41) could be arc in cross section as shown in FIG. 11(A); however, such a shape causes a high pressure loss at the air inlet ends (41*a*), thereby causing large splits of current on the negative pressure surface side. As a result, the air inlet ends (41*a*) of this shape are highly likely to cause a pressure fluctuation on the rib surfaces, which develops noise of a high level.

Since the current from the fan (6) fluctuates over time, the angle at which the current flowing into the board-shaped ribs (41) of the fan guard (4) also fluctuates over time.

Therefore, it is preferable that the air inlet ends (41*a*) of the board-shaped ribs (41) are designed to be approximately arc in cross section so that the pressure fluctuation on the rib surfaces can be reduced effectively even if the angle at which the current goes into the board-shaped ribs (41) fluctuates over time.

Figure 11:
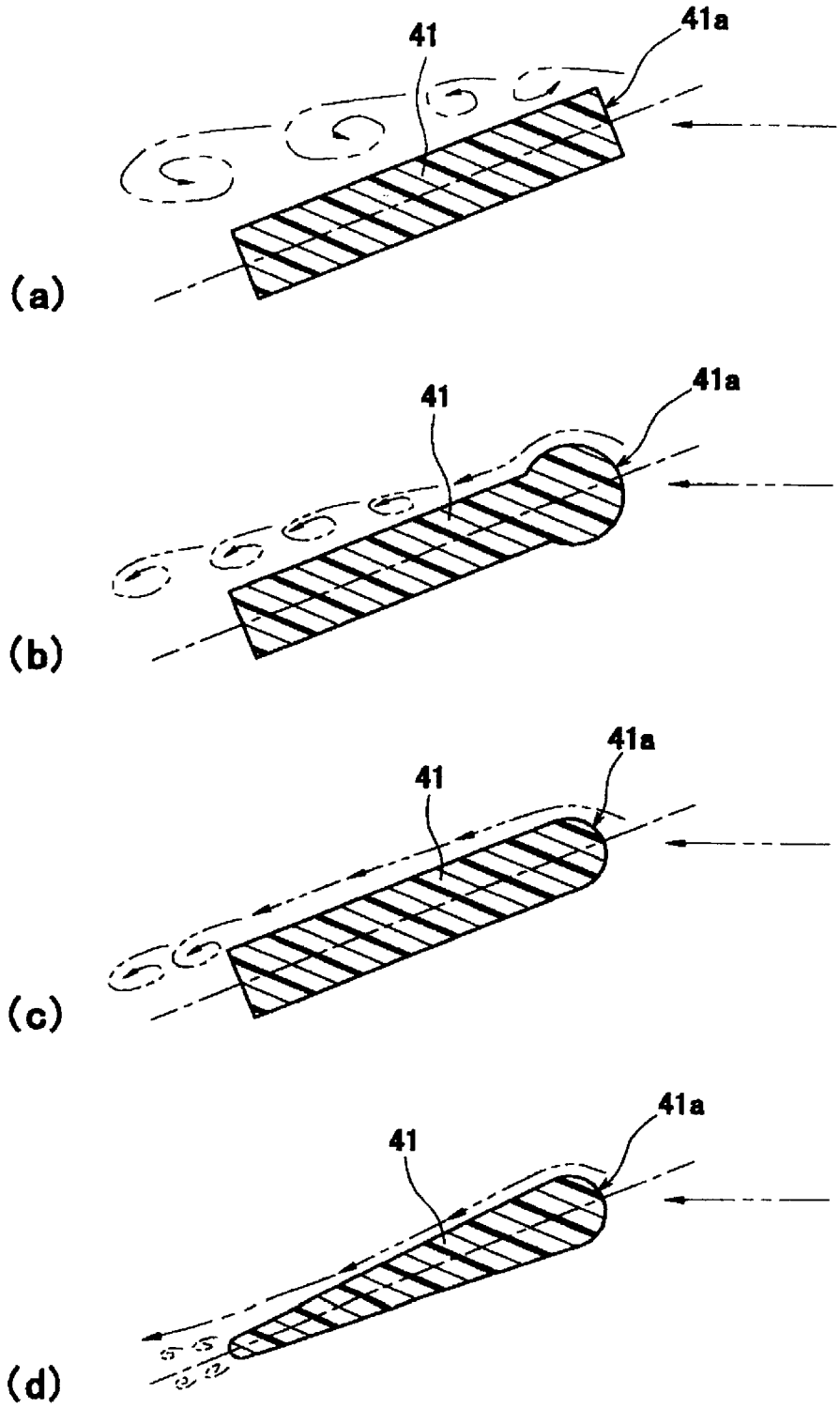
FIG. 11 are cross sectional views of the air inlet ends of the board-shaped ribs in Embodiment 1.

In that case, the air inlet ends (42*a*) can be various shapes including the one shown in FIG. 11(B) where the end (42*a*) is thickened to be shaped like a circle, the one shown in FIG. 11(*c*) where the thickness is equal, and the one shown in FIG. 11(*d*) where the thickness is reduced from the upstream side towards the downstream side.

However, when the thickness of the air inlet end (41*a*) is increased like a circle as shown in FIG. 11(B), the effect of preventing split of current is not sufficient in the downstream side of the negative pressure surface. Therefore, the one shown in FIG. 11(*c*) or 11(*d*) is preferable.

In the cross sectional profiles of the air inlet ends (41*a*) shown in FIGS. 11(*c*) and 11(*d*), the pressure fluctuation on the rib surfaces can be effectively reduced even if the angle at which the current goes into the board-shaped ribs (41) fluctuates over time, thereby further improving the above-mentioned effect of reducing the noise.

The fluctuation over time in the angle at which the current goes into the board-shaped ribs (41) of the fan guard (4) increases as it gets closer to the rear edges of the blades (6*b*) of the fan (6). Consequently, the above-mentioned cross sectional profiles can make the fan guard (4) further thinner in size.

Figure 12:
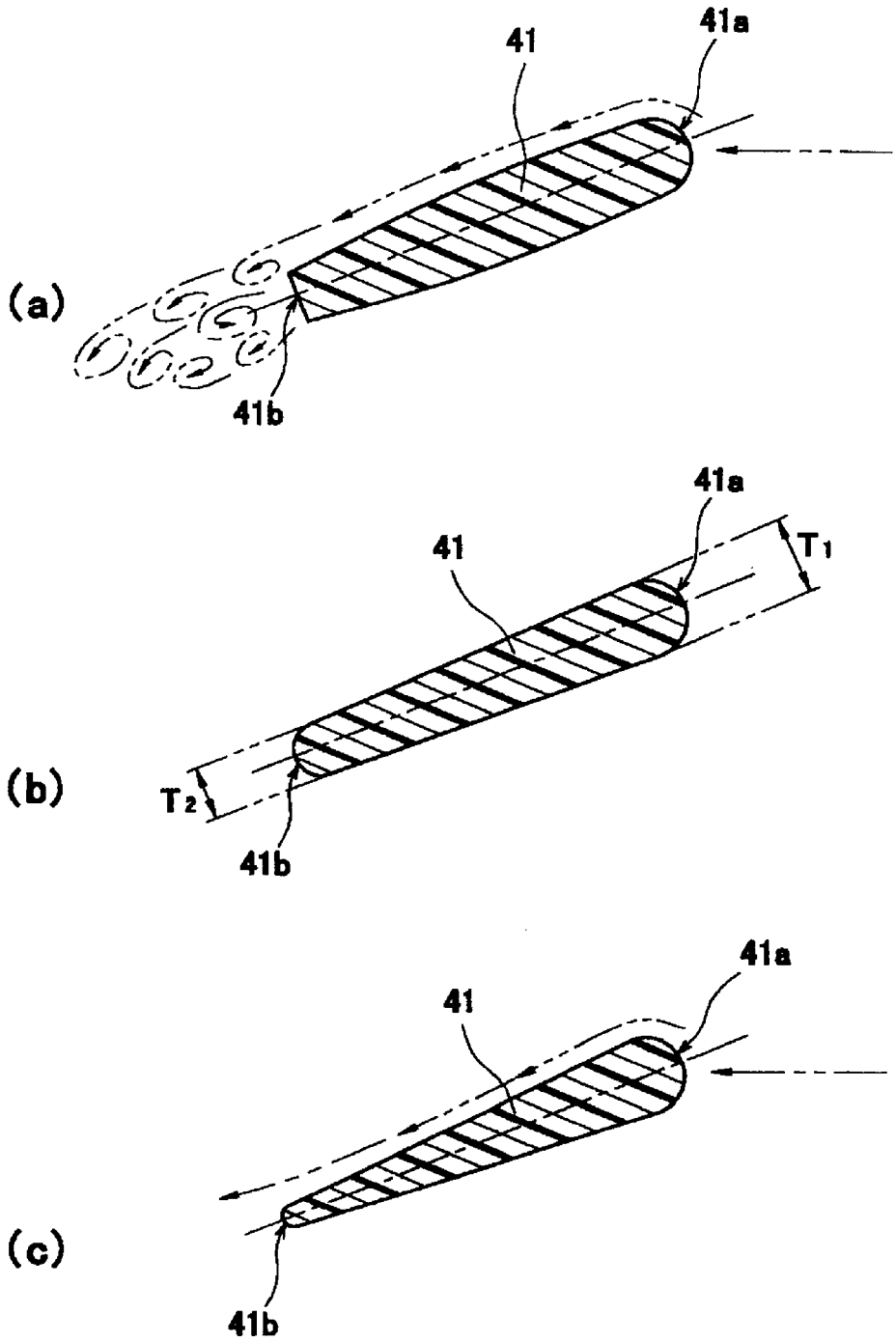
FIG. 12 are cross sectional views of the board-shaped ribs in Embodiment 1.
Figure 13:
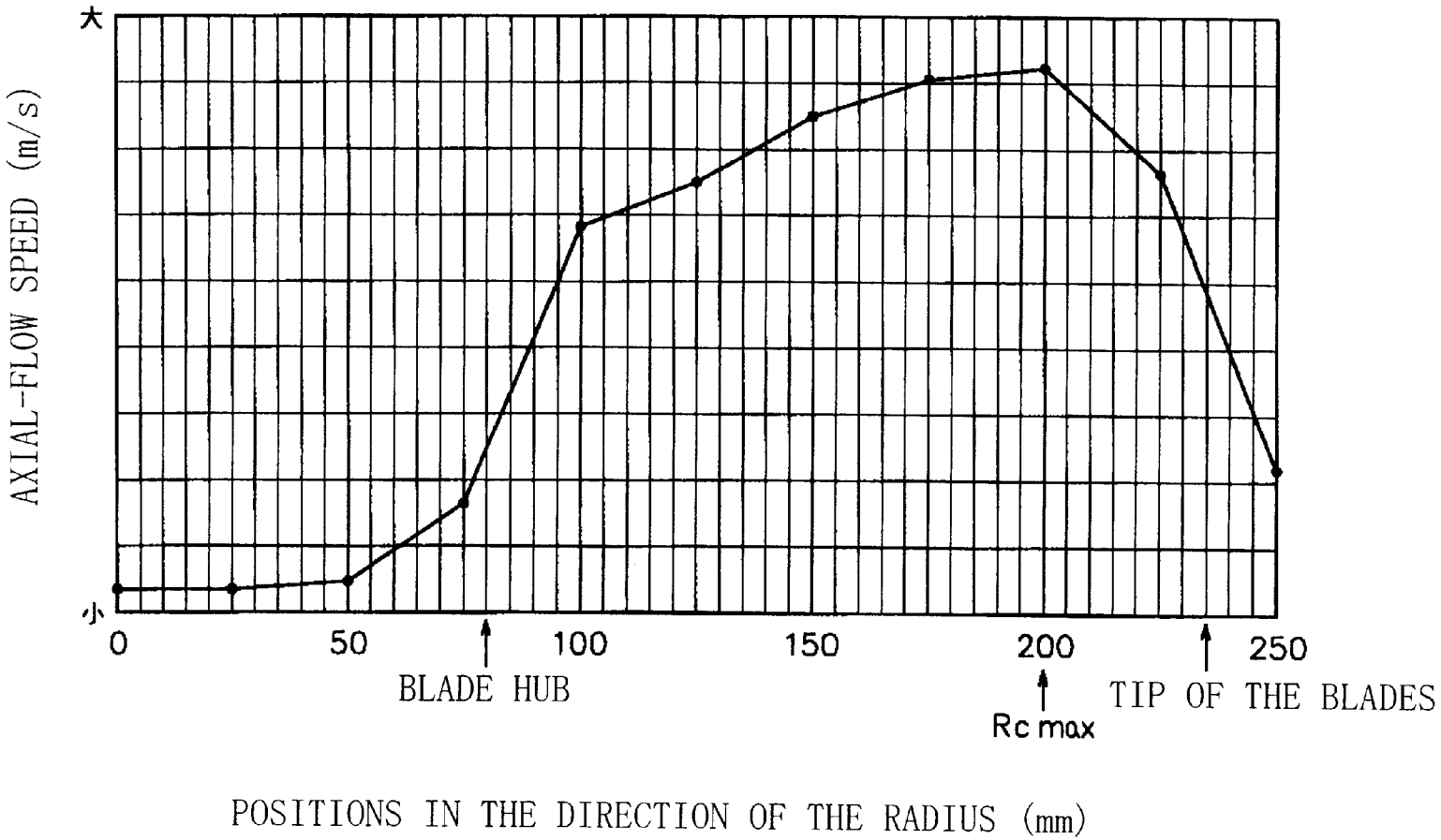
FIG. 13 is a graph showing the distribution of the axial-flow speed of the current from the fan in the direction of the radius of the fan (6) in the air blowing unit.

On the other hand, in the case where the air inlet ends (41*a*) are designed to be nearly arc in cross section as shown in FIGS. 11(*c*) and 11(*d*), if the air outlet ends (41*b*) are rectangular in cross section like the one in FIG. 12(A), vortexes occur in the downstream side, which causes pressure fluctuation. Therefore, it is also preferable that the air outlet ends (41*b*) are nearly arc in cross section as shown in FIGS. 12(B) and 12(*c*).

However, these profiles are not the only condition to make the current from the positive pressure surface and the current from the negative pressure surface of the board-shaped ribs (41) be smoothly mixed in the downstream side of the rear edges, which are the air outlet ends (41*b*) of the board-shaped ribs (41).

In the fan guard (4) of the present embodiment, the board-shaped ribs (41) are designed to be arc in cross section at the air inlet ends (41*a*) and the air outlet ends (41*b*), and as shown in FIG. 12(*b*), the thickness ($T_2$) of the air outlet ends (41*b*) is designed to become gradually smaller than the maximum thickness ($T_1$) of the air inlet ends (41*a*).

Thus, the board-shaped ribs (41) are designed to be nearly arc in cross section at the air inlet ends (41*a*) and at the air outlet ends (41*b*). Furthermore, the thickness ($T_2$) of the air outlet ends (41*b*) are designed to gradually become smaller than the maximum thickness ($T_1$) of the air inlet ends (41*a*). These designs facilitate the mixing of current from both sides of the rib surface which occurs immediately after the downstream side of the rear edges of the board-shaped ribs (41), thereby making it harder to develop vortexes behind the ribs (41). As a result, these effects can be fully exerted even when it is necessary to increase the thickness of the ribs (41) in order to provide enough strength.

As shown in FIG. 4, the air inlet ends (42*a*) of the cylindrical ribs (42) are more protruded forward than the air inlet ends (41*a*) of the board-shaped ribs (41), while the air outlet ends (42*b*) of the cylindrical ribs (42) are more protruded toward the rear than the air outlet ends (41*b*) of the board-shaped ribs (41).

When the blades (6*b*) of the fan (6) pass through the positions of the board-shaped ribs (41), it is inevitable that some vortexes occur on each surface of the board-shaped ribs (41). On the other hand, the cylindrical ribs (42), which are along the current from the fan (6), cause almost no vortexes.

However, when the air inlet ends (41*a*) of the board-shaped ribs (41) are more protruded than the air inlet ends (42*a*) of the cylindrical ribs (42), vortexes occur at the air inlet ends (42*a*) of the cylindrical ribs (42) in the portions where the board-shaped ribs (41) and the cylindrical ribs (42) cross each other.

Therefore, in the present embodiment, the air inlet ends (42*a*) of the cylindrical ribs (42) are more protruded than the air inlet ends (41*a*) of the board-shaped ribs (41) so as to prevent the occurrence of vortexes at the air inlet ends (42*a*) of the cylindrical ribs (42). Consequently, the noises caused by the occurrence of the vortexes can be prevented.

The fan guard is usually molded by pulling out two molds in the direction of the air inlet ends (41*a*, 42*a*) and the air outlet ends (41*b*, 42*b*) of the board-shaped ribs (41) and the cylindrical ribs (42).

In this case, if the air inlet ends (41*a*) and the air outlet ends (41*b*) of the board-shaped ribs (41) were more protruded than the air inlet ends (42*a*) and the air outlet ends (42*b*) of the cylindrical ribs (41), undercut or other problems would occur at the portions where the board-shaped ribs (41) and the cylindrical ribs (42) cross each other. As a result, it would take time to mold the fan guard (4).

Therefore, in the present invention, the molding is facilitated by making the air inlet ends (42*a*) and the air outlet ends (42*b*) of the cylindrical ribs (42) more protruded than the air inlet ends (41*a*) and the air outlet ends (41*b*) of the board-shaped ribs (41).

In order to take countermeasures against noise due to the vortexes, the air inlet ends (42*a*) of the cylindrical ribs (42) can exclusively be more protruded than the air inlet ends (41*a*) of the board-shaped ribs (41).

MODIFIED EXAMPLE

In the embodiments described hereinbefore, as shown in FIG. 4, the cylindrical ribs (42) have the same effects as the board-shaped ribs (41) as a result that the air inlet ends (42*a*) are designed to be approximately arc in cross section. The cylindrical ribs (42) have an approximately uniform diameter from the air inlet ends (42*a*) to the air outlet ends (42*b*) as shown in FIG. 11(*c*) so as to facilitate molding performance.

Instead, the cylindrical ribs (42) can have the same structure as the board-shaped ribs (41). To be more specific, as shown in FIG. 12(B) or 12(*c*), in the cylindrical ribs (42), the air inlet ends (42*a*) and the air outlet ends (42*b*) can be arc in cross section, and the thickness ($T_1$) of the air outlet ends (42*b*) can be made gradually smaller than the maximum thickness ($T_1$) of the air inlet ends (42*a*).

Consequently, the cylindrical ribs (42) can provide the same effects as the board-shaped ribs (41).

Embodiment 2

Figure 15:
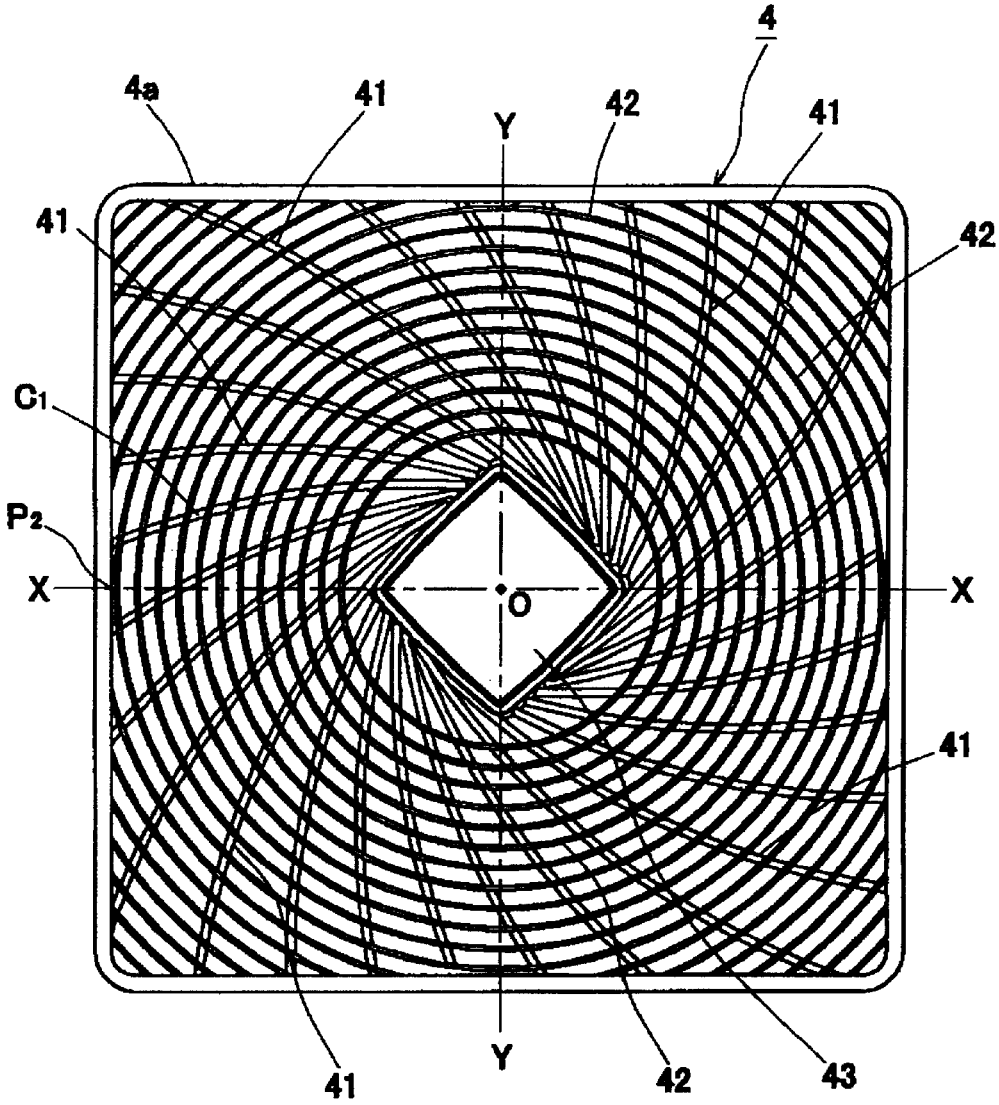
FIG. 15 is a front view of the fan guard of the air blowing unit of Embodiment 2 of the present invention.

FIG. 15 shows the structure of the fan guard of the air blowing unit of Embodiment 2 of the present invention.

In the present embodiment, the sealing plate (43) which is shaped like the frame (4*a*) of Embodiment 1 is rotated by 45 degrees on the rotation axis (O–O') of the fan (6). In other words, the sealing plate (43) is so arranged that its diagonal lines are in the vertical and horizontal directions. The other features of the structure are identical with those of Embodiment 1.

In this structure, the same effects as in Embodiment 1 can be obtained.

Embodiment 3

Figure 16:
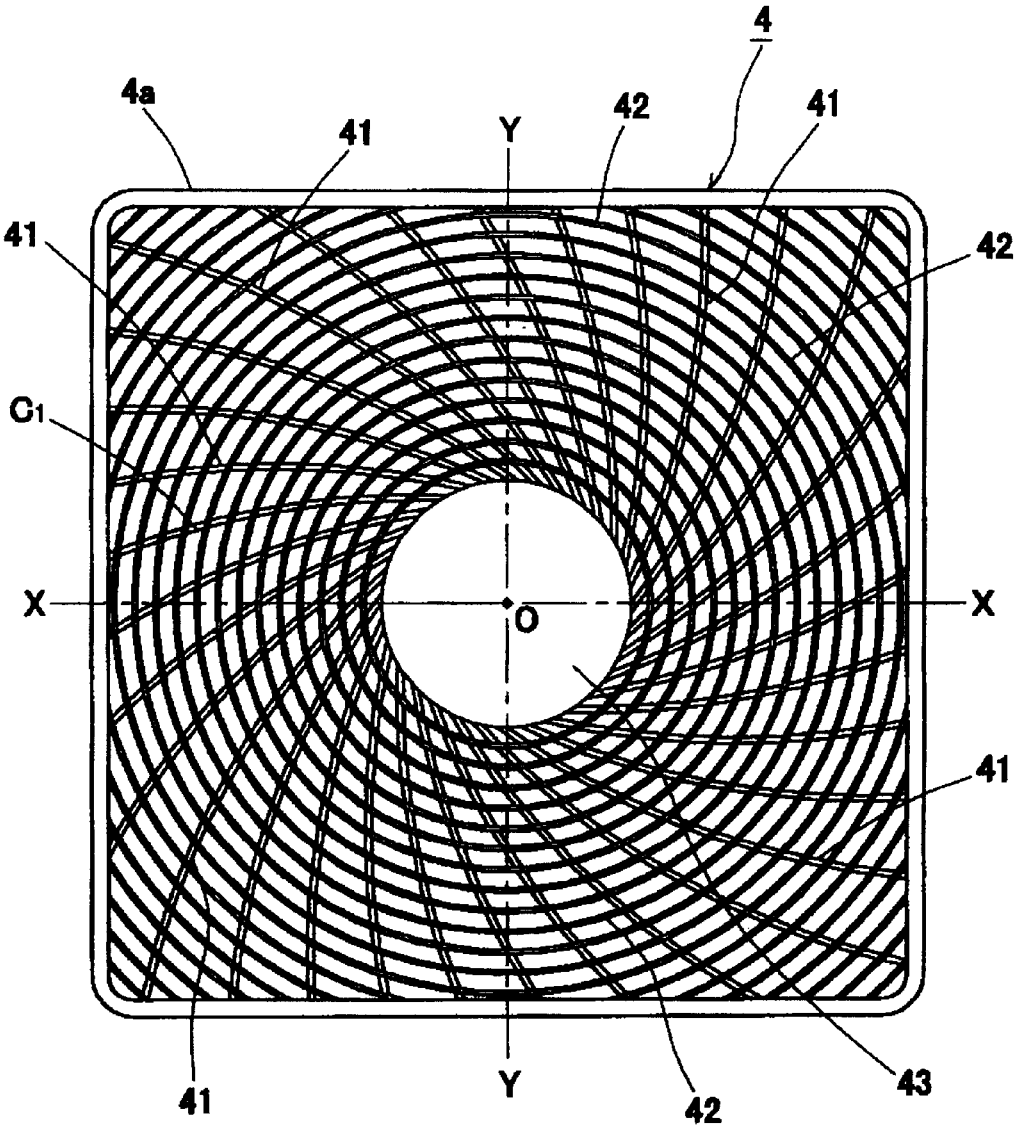
FIG. 16 is a front view of the fan guard of the air blowing unit of Embodiment 3 of the present invention.

FIG. 16 shows the structure of the fan guard of the air blowing unit of Embodiment 3 of the present invention.

In the present embodiment, the sealing plate (43) of the same structure as in Embodiment 1 is designed to be a circle concentric with the rotation axis (O–O') of the fan (6).

In this structure, the same effects as in Embodiment 1 can be obtained.

Embodiment 4

Figure 17:
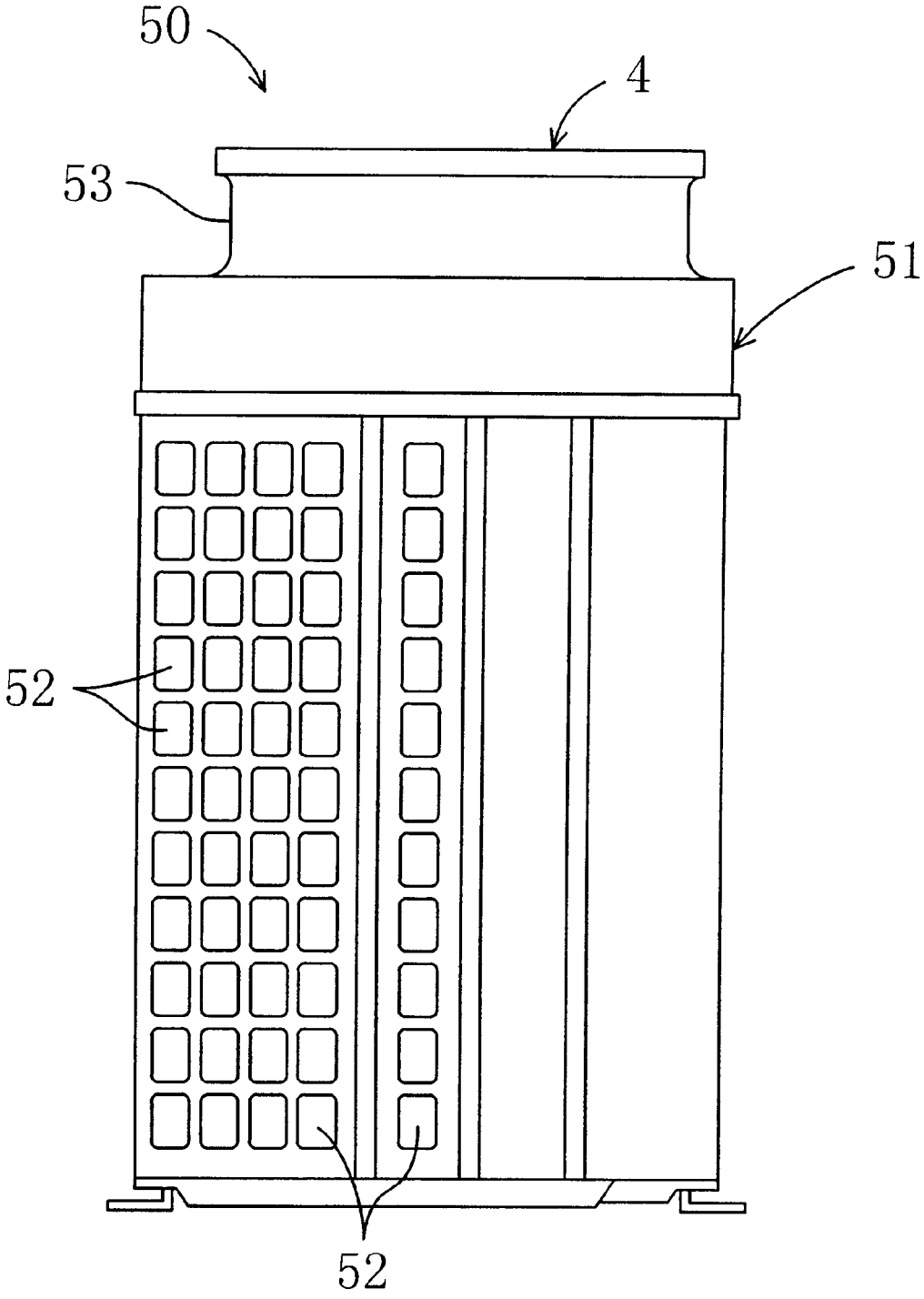
FIG. 17 is a front view of the outdoor unit of the air-conditioning device of Embodiment 4 of the present invention.
Figure 18:
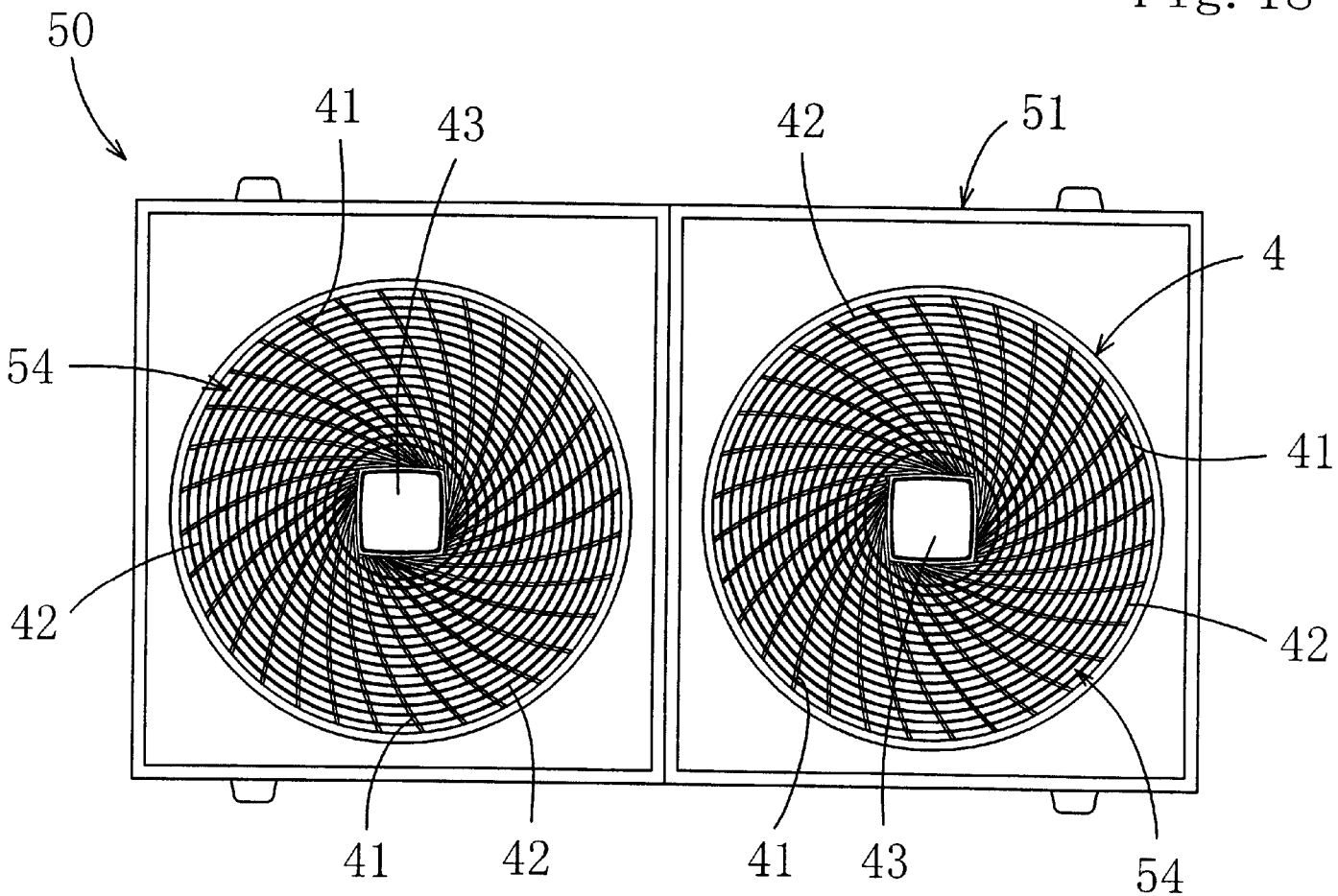
FIG. 18 is a plan view of the outdoor unit in Embodiment 4.
Figure 19:
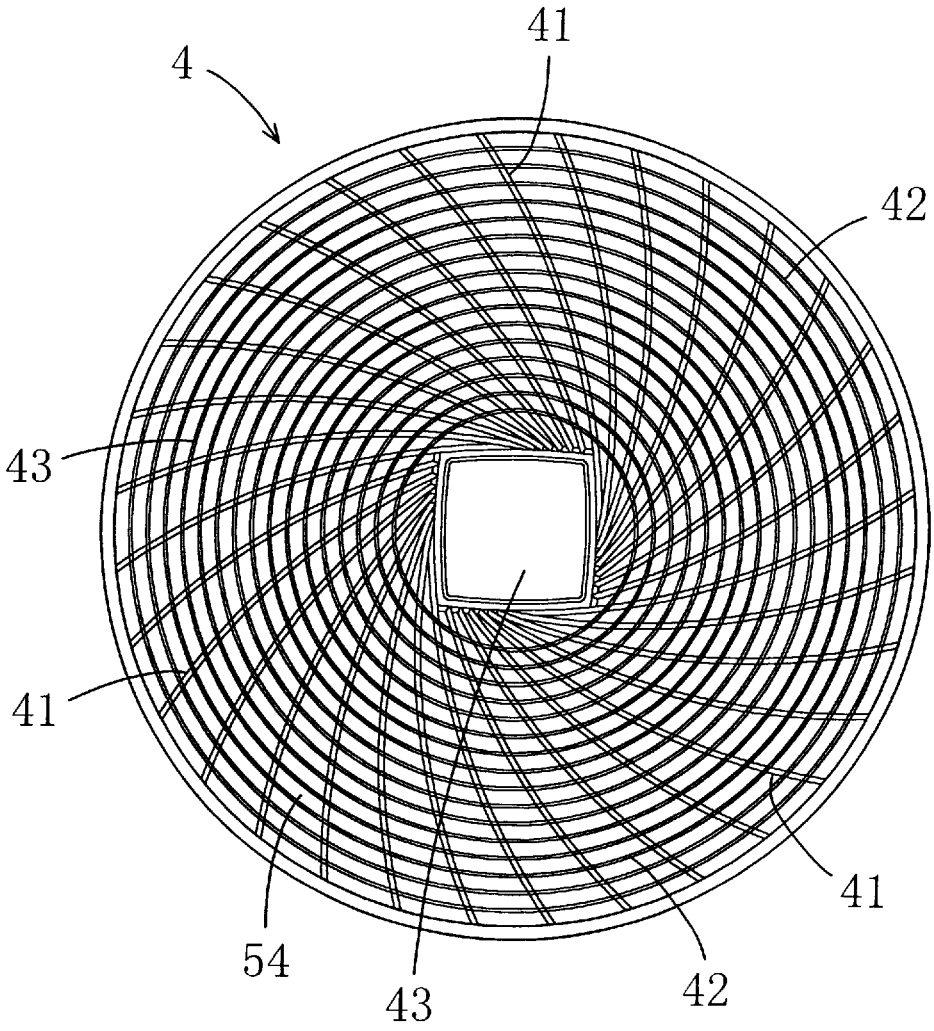
FIG. 19 is a plan view of the fan guard in Embodiment 4.
Figure 20:
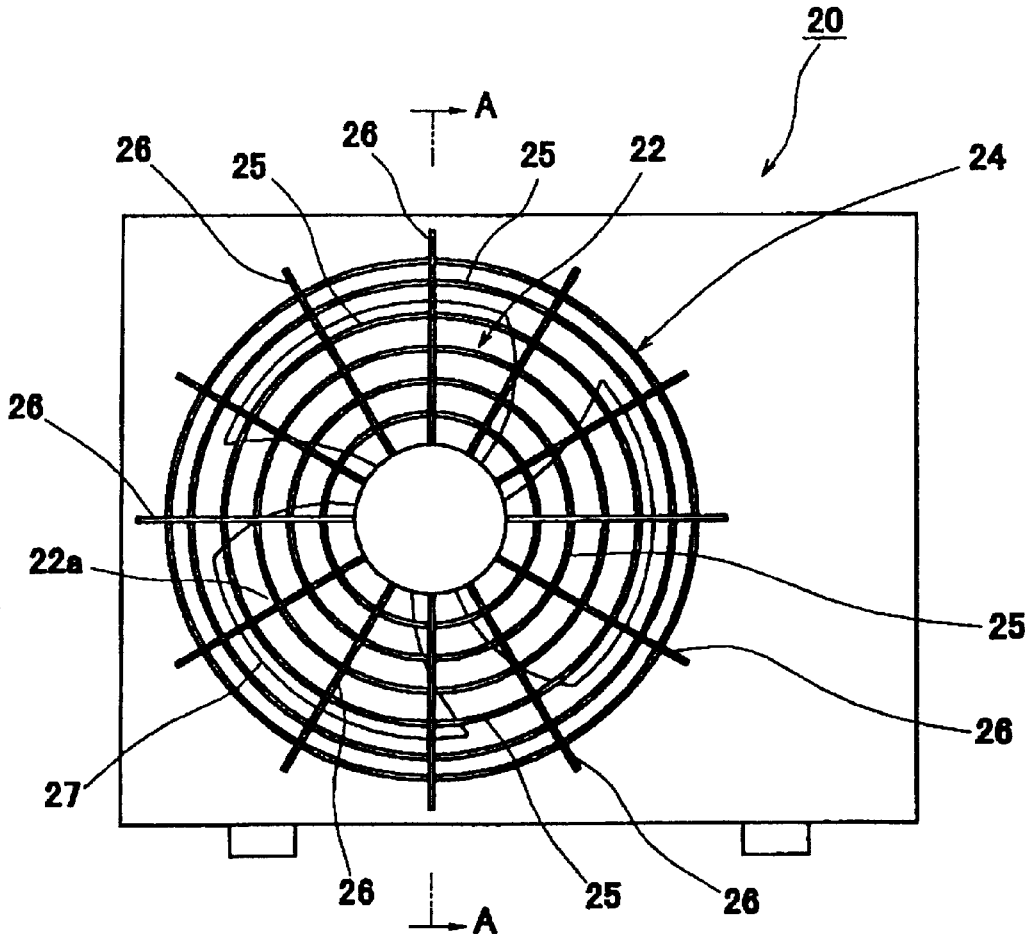
FIG. 20 is a front view of a prior art air blowing unit.
Figure 21:
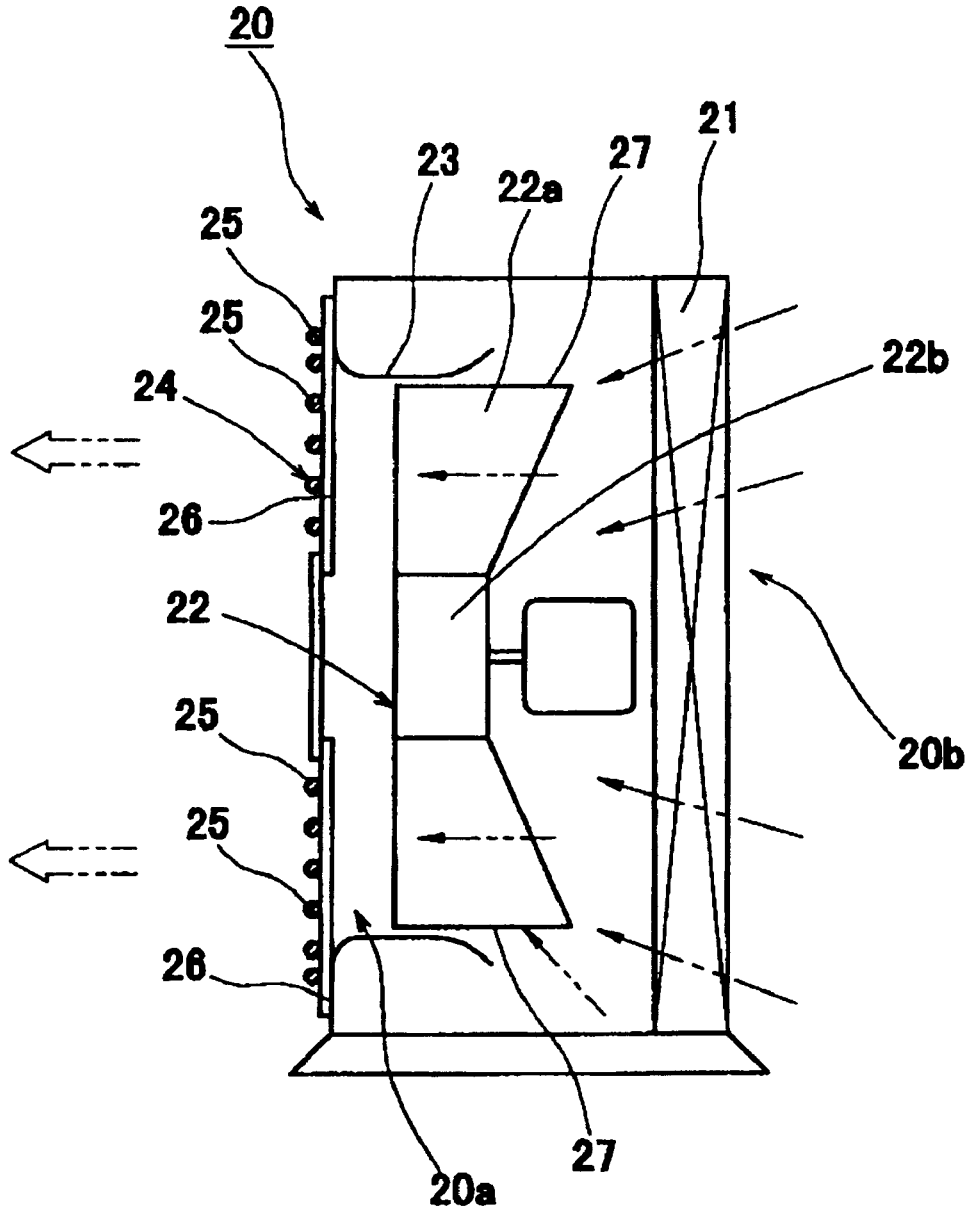
FIG. 21 is a cross sectional view taken along the line A—A of FIG. 20 showing the structure of the prior art air blowing unit.

FIGS. 17 and 18 show the outdoor unit (50) which is a heat source side unit of the air-conditioning device of Embodiment 4 of the present invention.

Like Embodiment 1, the fan guard (4) is applied to the outdoor unit (50). Although it is not illustrated, the outdoor unit (50) is connected with a plurality of indoor units, which are user's side units connected by a refrigerant tubing to form a refrigerant circuit between the outdoor unit (50) and the indoor units.

Unlike in Embodiment 1, the casing (51) of the outdoor unit (50) is oblong rectangular. The casing (51) includes a compressor, a heat exchanger, and two fans, which are not illustrated. The both side surfaces and the back surface of the casing (51) include a number of fine pores which form the air inlet (52).

At the top of the casing (51), two cylindrical bell mouths (53, 53) are protruded corresponding to the two fans. The top end surface of each bell mouth (53) is designed to be the outlet (54). At the top end of the bell mouth (53), the fan guard (4) is installed.

The fan guard (4), which is rectangular in Embodiment 1, is designed to be circular in the present embodiment. As a result, the frame (4*a*) of the fan guard (4) is circular.

Similar to Embodiment 1, the fan guard (4) comprises an approximately rectangular sealing plate (43), board-shaped ribs (41), and cylindrical ribs (42) all of which have the same structure and effects as in Embodiment 1. The fan guard (4) of Embodiment 4 can be a modified example of Embodiment 1.

Embodiment 4 has two fans and two fan guards (4); however, the present invention can be realized by providing one fan and one fan guard (4). Instead, it is possible to provide more than two fans and more than two fan guards (4).

The fan guards (4) of Embodiment 4 can be replaced by the fan guards (4) used in Embodiment 3. To be more specific, the sealing plate (43) can be a circle having the same axis as the rotation axis (O–O') of the fan (6). On the contrary, the fan guards (4) of Embodiment 4 can be an approximate rectangle like in Embodiment 1. As a result, the frames (4*a*) of the fan guards (4) can be approximately rectangular.

In Embodiments 1 to 4, the board-shaped ribs (41) of the fan guards (4) are curved outward; instead, however, the board-shaped ribs (41) of the present invention can be inclined straight in the direction of rotation of the fan (6) from a point on the inner circumference to a point on the outer circumference.

Industrial Applicability

As described hereinbefore, the fan guard of the air blowing unit and the air-conditioning device of the present invention are useful to any apparatus provided with a fan, and particularly suitable to the heat source side unit of the air-conditioning device.

What is claimed is:

1. A fan guard of an air blowing unit comprising:

a frame (4*a*) arranged around a perimeter of an air outlet (2*a*) of a fan (6); and a plurality of board-shaped ribs (41, 41 . . . ) extending radially from a vicinity of the center of the frame (4*a*) outward in a direction of a radius of the fan (6), wherein a line (A) connecting an air inlet end (41*a*) and an air outlet end (41*b*) of each of the plurality of board-shaped ribs (41) in a cross section perpendicular to a line ($C_1$) formed by the air outlet end (41*b*) of each of the plurality of board-shaped ribs (41) is inclined from a rotation axis (0–0') of the fan (6) by a predetermined angle (θr) of installment in the direction of rotation of the fan (6), and a point ($P_2$) at an outer radial end of the air outlet end (41*b*) of each of the plurality of board-shaped ribs (41) is positioned at a point rotated in the direction of rotation of the fan (6) from a straight line (B) connecting a point ($P_1$) at an inner radial end of the air outlet end (41*b*) and the rotation axis (0–0').

2. A fan guard of an air blowing unit comprising:

a frame (4*a*) arranged around a perimeter of an air outlet (2*a*) of a fan (6);

a plurality of board-shaped ribs (41, 41 . . . ) extending radially from a vicinity of the center of the frame (4*a*) outward in a direction of a radius of the fan (6); and a plurality of nearly cylindrical ribs (42, 42 . . . ) which are integrated with the plurality of board-shaped ribs (41, 41 . . . ) and arranged concentrically around a rotation axis (0–0') of the fan (6) at predetermined intervals in the direction of the radius of the fan (6), wherein a line (A) connecting an air inlet end (41*a*) and an air outlet end (41*b*) of each of the plurality of board-shaped ribs (41) in a cross section perpendicular to a line ($C_1$) formed by the air outlet end (41*b*) of each of the plurality of board-shaped ribs (41) is inclined from the rotation axis (0–0') of the fan (6) by a predetermined angle (θr) of installment in the direction of rotation of the fan (6), and a point ($P_2$) at an outer radial end of the air outlet end (41*b*) of each of the plurality of board-shaped ribs (41) is positioned at a point rotated in the direction of rotation of the fan (6) from a straight line (B) connecting a point ($P_1$) at an inner radial end of the air outlet end (41*b*) and the rotation axis (0–0').

3. A fan guard of an air blowing unit comprising:

a frame (4*a*) arranged around a perimeter of an air outlet (2*a*) of a fan (6); and a plurality of board-shaped ribs (41, 41 . . . ) extending radially from a vicinity of the center of the frame (4*a*) outward in a direction of a radius of the fan (6), wherein an air outlet end (41*b*) of each of the plurality of board-shaped ribs (41) in a cross section perpendicular to a line ($C_1$) formed by the air outlet end (41*b*) of each of the plurality of board-shaped ribs (41) is positioned at a point rotated in the direction of the fan (6) from an air inlet end (41*a*) of each of the plurality of board-shaped ribs (41) in the cross section perpendicular, and a point ($P_2$) on an outer circumference of the air outlet end (41*b*) of each of the plurality of board-shaped ribs (41) is positioned at a point rotated in the direction of rotation of the fan (6) from a straight line (B) connecting a point ($P_1$) on an inner circumference of the air outlet end (41*b*) and a rotation center (0) of the fan (6).

4. A fan guard of an air blowing unit comprising:

a frame (4*a*) arranged around a perimeter of an air outlet (2*a*) of a fan (6);

a plurality of board-shaped ribs (41, 41 . . . ) extending radially from a vicinity of the center of the frame (4*a*) outward in a direction of a radius of the fan (6); and a plurality of nearly cylindrical ribs (42, 42 . . . ) which are integrated with the plurality of board-shaped ribs (41, 41 . . . ) and arranged concentrically around a rotation axis (0–0') of the fan (6) at predetermined intervals in the direction of the radius of the fan (6);

wherein an air outlet end (41*b*) of each of the plurality of board-shaped ribs (41) in a cross section perpendicular to a line ($C_1$) formed by the air outlet end (41*b*) of each of the plurality of board-shaped ribs (41) is positioned at a point rotated in the direction of the fan (6) from an air inlet end (41*a*) of each of the plurality of board-shaped ribs (41) in the cross section perpendicular, and a point ($P_2$) on an outer circumference of the air outlet end (41*b*) of each of the plurality of board-shaped ribs (41) is positioned at a point rotated in the direction of rotation of the fan (6) from a straight line (B) connecting a point ($P_1$) on an inner circumference of the air outlet end (41*b*) and a rotation center (0) of the fan (6).

5. The fan guard of an air blowing unit of either one of claim 1 to claim 2, wherein an inner dimension ($\psi_1$) of the frame (4*a*) is designed to be larger than an inner diameter ($\psi_2$) of an air outlet edge of the air outlet (2*a*) upstream of the fan guard (4).

6. The fan guard of an air blowing unit of either one of claims 1, 2, 3 and 4, wherein the line ($C_1$) formed by the air outlet end (41*b*) of each of the board-shaped ribs (41) is a curve where an angle ($\theta\alpha$) which the line ($C_1$) forms with a direction tangent to the nearly cylindrical ribs (42) grows from inside to outside in the direction of the radius of the fan (6).

7. The fan guard of an air blowing unit of claim 6, wherein said angle ($\theta r$) at which the board-shaped ribs (41) are installed is made approximately equal to an angle ($\theta i$) at which air flows from the fan (6) in a diametrical position (Rcmax) where a speed component (CZ) of the current from the fan (6) in the axial direction is the largest and is approximately uniform in the direction of the radius of the fan (6).

8. The fan guard of an air blowing unit of either one of claims 1, 2, 3 and 4, wherein a number (Zr) of the board-shaped ribs (41) is different from a number (Zb) of blades (6*b*) of the fan (6) or a multiple of the number (Zb), and when a midpoint position of the curve ($C_1$) formed by the air outlet end (41*b*) of each of the board-shaped ribs (41) and a midpoint position of a curve ($C_2$) of a rear edge of each of the blades (6*b*) of the fan (6) coincide with each other with respect to a surface perpendicular to the rotation axis (0–0'), the curves ($C_1$, $C_2$) cross each other.

9. The fan guard of an air blowing unit of either one of claims 1, 2, 3 and 4, wherein the air inlet end (41*a*) of each of the board-shaped ribs (41) is approximately arc in cross section.

10. The fan guard of an air blowing unit of either one of claims 1, 2, 3 and 4, wherein a thickness ($T_2$) of the air outlet ends (41*b*, 42*b*) of the board-shaped ribs (41) is designed to be smaller than a maximum thickness ($T_1$).

11. The fan guard of an air blowing unit of either one of claims 1, 2, 3 and 4, wherein a sealing plate (43) is provided at the center of the frame (4*a*) corresponding to the rotation axis (0–0').

12. The fan guard of an air blowing unit of either one of claims 1, 2, 3 and 4, wherein the frame (4*a*) is approximately rectangular.

13. The fan guard of an air blowing unit of either one of claims 1, 2, 3 and 4, wherein the air inlet end (42*a*) of each of the nearly cylindrical ribs (42) is more protruded than the air inlet end (41*a*) of each of the board-shaped ribs (41).

14. The fan guard of an air blowing unit of either one of claims 1, 2, 3 and 4, wherein the air inlet end (42*a*) of each of the nearly cylindrical ribs (42) is more protruded than the air inlet end (41*a*) of each of the board-shaped ribs (41), and the air outlet end (41*b*) of each of the nearly cylindrical ribs (42) is more protruded than the air outlet end (41*b*) of each of the board-shaped ribs (41).

15. An air-conditioning device provided with the fan guard (4) of the air blowing unit of either one of claims 1, 2, 3 and 4, comprising:

a heat source side unit (50); and a user's side unit, wherein the heat source side unit (50) includes at least a heat exchanger and a fan stored in a casing (51), is provided with an air outlet (54) covered by the fan guard (4).

16. The fan guard of an air blowing unit of either one of claims 1, 2, 3 and 4, wherein the air inlet end (42*a*) of each of the nearly cylindrical ribs (42) is approximately arc in cross section.

17. The fan guard of an air blowing unit of either one of claims 1, 2, 3 and 4, wherein a thickness ($T_2$) of the air outlet ends (41*b*, 42*b*) of the nearly cylindrical ribs (42) is designed to be smaller than a maximum thickness ($T_1$).

* * * * *